United States Patent [19]

Dillon

[11] 4,321,847

[45] Mar. 30, 1982

[54] CONTINUOUS COLD CUT SLICING MACHINE

[75] Inventor: Oscar W. Dillon, Essex, Conn.

[73] Assignee: Cashin Systems Corp., Williston Park, N.Y.

[21] Appl. No.: 92,665

[22] Filed: Nov. 9, 1979

[51] Int. Cl.[3] ..... B26D 7/30; B26D 5/20

[52] U.S. Cl. ..... 82/77; 83/251; 83/278; 83/367; 83/409

[58] Field of Search ..... 83/77, 206, 251, 262, 83/277, 278, 354, 355, 409, 415, 367

[56] References Cited

U.S. PATENT DOCUMENTS

| | | | |
|---|---|---|---|
| 1,973,919 | 9/1934 | Walter | 83/367 |
| 2,060,540 | 11/1936 | Straeten | 83/355 |
| 2,699,806 | 1/1955 | Gardner | 83/415 |
| 2,752,968 | 7/1956 | Toby et al. | 83/206 |
| 3,129,733 | 4/1964 | Dargan et al. | 83/409 |
| 3,162,226 | 12/1964 | Toby et al. | 83/206 |
| 3,446,499 | 5/1969 | Ringler | 83/251 |
| 3,605,538 | 9/1971 | Bohmer et al. | 83/206 |
| 3,820,431 | 6/1974 | Peddinghalls | 83/278 |
| 3,880,295 | 4/1975 | Wyslotsky | 83/409 |
| 4,015,494 | 4/1977 | Spooner et al. | 83/409 |
| 4,060,875 | 12/1977 | Gosling et al. | 83/278 |

*Primary Examiner*—James M. Meister
*Assistant Examiner*—K. Bradford Adolphson
*Attorney, Agent, or Firm*—Kane, Dalsimer, Kane, Sullivan & Kurucz

[57] ABSTRACT

A continuous cold cut slicing system utilizing a slicing machine having a conveyor which feeds a loaf into engagement with a series of drums located on each side of the slicing machine channel; the drums are driven by a variable speed motor with the rotation of the drums providing a feed mechanism of the product to the slicing blade. A gripper assembly is provided which rides on a guide shaft adjacent the channel with the movement of the gripper in the channel constantly being monitored by an encoder and clutch arrangement connected thereto. As the gripper approaches the knife, the encoder and clutch arrangement provide for a drag on the gripper thereby controlling the feed of the product compensating for pull on the knife. Also, since the encoder and clutch arrangement are constantly monitoring the position of the gripper the exact location of the tail end of the loaf being sliced is readily determinable so that a profile compensation control system may be effectively incorporated into the system. Upon completion of slicing of a loaf, the drive of the product ceases, the gripper is retracted and during the short interval an automatic tare correction system may be activated so as to compensate for scraps or grease on the weighing apparatus.

32 Claims, 21 Drawing Figures

CONTINUOUS COLD CUT SLICING MACHINE

BACKGROUND OF THE INVENTION

The present invention relates to improvements and apparatus for slicing food products and arranging them in a stacked form of controlled weight; apparatus of this type is disclosed and commonly assigned U.S. Pat. Nos. 2,903,032, granted Sept. 9, 1959, 3,099,304, granted July 30, 1963, 3,200,864, granted Aug. 18, 1965, 3,204,676, granted Sept. 7, 1965, 3,835,742, granted Sept. 17, 1974, 3,846,957, granted Nov. 12, 1974, 3,846,958, granted Nov. 12, 1974, 3,880,035, granted Apr. 29, 1975, 3,905,259, granted Sept. 16, 1975, 3,906,823, granted Sept. 23, 1975, 3,910,141, granted Oct. 7, 1975, 3,933,066, granted Jan. 20, 1976, 4,015,494, granted Apr. 5, 1977, and U.S. Letters patent application Ser. No. 849,528 filed Nov. 7, 1977 abandoned in favor of continuation-in-part application Ser. No. 92,195 filed Nov. 6, 1979 commonly assigned herein.

While apparatus of the type disclosed in these patents have proven to be satisfactory, it is desirable to upgrade their operation of such systems with the maximum amount of slicing of products and integrity of stack being realized. In addition, it is also desirable to maintain an effective control over the product being sliced throughout the slicing cycle thereby preventing the throw-off or splattering of product resulting in disruption of weighing process and inconsistency in stack weight.

Usually, in the conventional machines, the approach is to have a tractor metering feed belt throughout the entire length of the channel bed, with various hold-down devices incorporated to effectively control the loaf against pull by the blade and rotation as it is being sliced. Usually included therewith is a gripper assembly which utilizes vacuum suction and grips the tail end as a means of removing the butt end before it is splattered by the knife. Also the use of tractor metering feed is expensive, and in addition does not provide the most effective control of the slice, allowing splattering of the loaf which interfers with the weighing of the product, as aforementioned. This necessitates the cleaning of the machine on a relatively frequent basis thereby inhibiting the effective operation of a continuous machine.

In such conventional systems, the usual time per slicing of a loaf is approximately 28 to 30 seconds, with a 10 second period necessary for retracting the gripper so that the next succeeding loaf could pass on to be fed into the slicing blade. The retraction time of the conventional systems is approximately $\frac{1}{3}$ of the cutting time, and efficiency is lost due to idleness of the machine during this period.

In addition, incorporation of the profile compensation control system as disclosed in the aforementioned application, in the present systems, while effective, may be improved through the use of a means of determining in the exact location of the tail end of the loaf being sliced, which presently is somewhat estimated for so that accuracy in determining when the rear count should begin is at a somewhat disadvantage.

SUMMARY OF THE INVENTION

Accordingly, it is the principal object of the present invention to control the feed of the product close to the knife thereby preventing loss of product and splattering, which disrupts the weighing operation and the cleanliness of the machine.

It is a further object to provide for a continuous cold cut slicing system with an improved cutting period, minimizing the retraction time necessary for the gripper assembly.

It is yet a further object to provide for feed mechanism which is less costly than the tractor belt while being capable of providing an effective feed of the product to the knife.

Another object is to provide for a slicing machine which will effectually allow for the incorporation of the profile compensating control system while in addition being capable of providing, during continuous operation of the system, a period where the automatic tare correction control system may also be utilized.

With regard to the foregoing, the present invention provides for a continuous cold cut slicing system which utilizes a slicing machine which allows for a somewhat continuous and control product feed to a point close to the knife thereby preventing loss of product and integrity of the stacks. The product is initially feed to a conveyor which feeds the loaf into engagement with a series of drums, located on each side of the slicing machine channel. These drums are driven by a variable speed motor, responsive to standard slice thickness control, with the rotation of the drums providing a feed mechanism of the product to the blade.

Once the product has been sliced down to a sufficient length, a gripper assembly, which rides on a guide shaft adjacent to said channel, is tilted so that the gripper is located in the channel. The next succeeding loaf is now used to push the gripper and carriage, which is a free-wheeling arrangement at this time, thereby advantageously eliminating any synchronization heretofore thought necessary, towards the trailing end of the loaf being sliced until said gripper engages said end.

Movement of the carriage and gripper in the channel is constantly being monitored by an encoder and clutch arrangement connected thereto. When the loaf being sliced has passed beyond the drums, the loaf is being now fed by way of the gripper which is driven by the next succeeding loaf. As the gripper approaches the knife, the encoder and clutch arrangement provides for a drag on the gripper thereby controlling the feed of the product, compensating for any pull caused by the rotation of the knife.

In addition, since the encoder and clutch arrangement are constantly monitoring the position of the gripper and carriage, the exact location of the tail end of the loaf being sliced are readily determinable so that the profile compensation control system may be effectively incorporated to provide for adjustments of the machine to accommodate the common tapers on the front and back end of the loaf.

Once the slicing is completed, for approximately three seconds, the drive motors for the drums and conveyor are disengaged and the gripper and carriage assembly are removed from the channel and retracted, with the next succeeding loaf then being fed quickly into the knife. During this time the weighing apparatus may be signaled so that the automatic tare correction system may be activated so as to compensate for any scraps or grease on the weighing apparatus.

Since the retraction of the gripper and carriage assembly is not the length of the channel, but rather a mere portion thereof, such retraction time is only approximately three seconds as compared to the conventional ten seconds thereby allowing somewhat continuous slicing of the product without idle time for the machine. Also, through the use of such a system the automatic tare correction system and profile compensation control system may be incorporated in the machine in a most effective manner not heretofore realized.

Other objects and advantages will become apparent from the following detailed description of which is to be taken in conjunction with the accompanying drawings.

DETAILED DESCRIPTION OF THE DRAWINGS

Figure 1A:
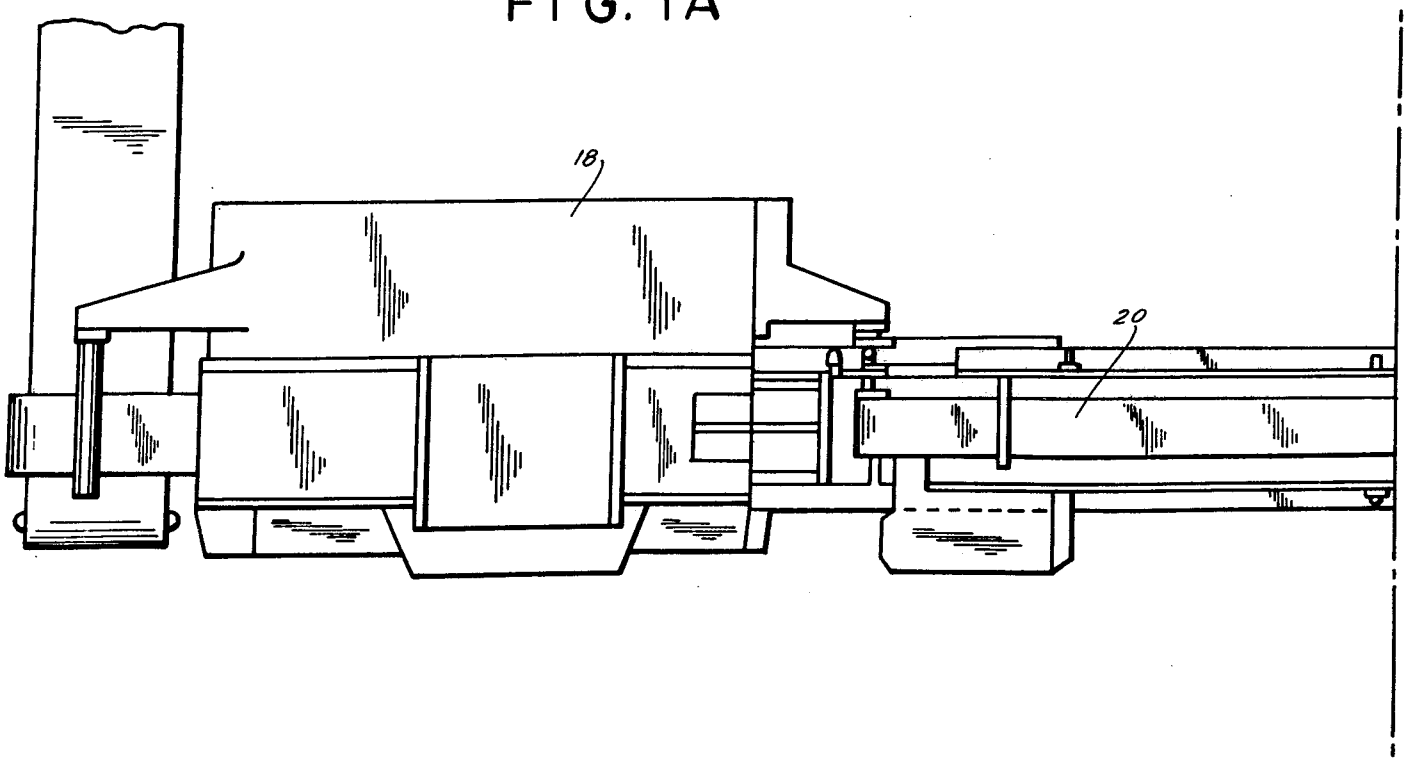
FIGS. 1A and 1B depict a top plan view of the system incorporating the teachings of the invention.

Referring now to FIGS. 1A through 2B, there is shown an entire meat slicing, weighing and packaging system. The system includes a weighing while-conveying-apparatus 10 and a stacker 12 shown at the discharge end of a slicing machine 14. The sliced produced by the slicing machine, are discharged onto the stacker and from there as a stack or batch onto a conveyor 16 of the weighing while conveying apparatus 10. The stack is then transferred to a packing station 18 by a transverse conveyor 20, if it is of the correct weight, as determined by the weighing apparatus 10. If not, the stack is moved by an interposed rejection conveyor 22 to make-weight station 24 at which point the proper weight is made.

STACKER

The drawings illustrate one type of stacker which may be utilized in the system, however, it should be understood that the illustrated stacker does not per se constitute the present invention. The stacker 12 shown is usually driven in a time relationship with the knife shaft 26 of the slicer 14, and receives slices of the product 28, collects them in a stack, and after the slicing blade 30 has cut the last slice, deposits the stack on the conveyor 16 of the weighing apparatus 10. This type of stacker is disclosed in U.S. Pat. Nos. 3,200,864 and 3,204,676 as well as the references incorporated therein. If so desired, a dual speed version of this type of stacker, as disclosed in the U.S. Pat. No. 3,933,066 may be utilized in its place.

A yet further option may be the use of the stacker of a type located on the weighing apparatus of the system, as shown in U.S. Pat. Nos. 3,835,742; 3,905,259 and 3,906,823 and the references incorporated therein. This of course allows for incorporating the various inventive features as disclosed by each of said patents into the system by way of modifications to the associated apparatus, as discussed in the respective patents. In this regard, for example, the interrelationship between the weighing apparatus and the slicing machine so as to provide slice thickness control may be utilized as discussed in the aforenoted patents. This is usually accomplished by way of interconnecting the scale 32 of the weighing apparatus to a servo mechanism which accepts signals from the scale to adjust the speed of the feeder of the product 28 to be sliced to the blade 30. This is discussed, for example, in U.S. Pat. No. 3,200,864 where the stacker is located on the slicing machine, or in the case where the stacker is located on the weighing apparatus, as described in U.S. Pat. No. 3,835,742. In either case, slice thickness control is usually accomplished by adjusting the feed of the loaf into the slicer, wherein the slice thickness control is coupled to the feeder or driving means to increase or decrease the rate of speed and consequently increase or decrease the slice thickness. This control is usually automatically adjusted in response to a feedback signal from the weighing apparatus as discussed for example in U.S. Pat No. 3,200,864 Column 3, lines 1-36; Column 4, lines 3-39, 74-75; Column 5, lines 1-26; Column 7, line 36—Column 8, line 28; Column 11, line 65—Column 13, line 65; U.S. Pat. No. 3,204,676; Column 11, line 70—Column 12, line 14; Column 13, line 1—Column 14, line 74; U.S. Pat. No. 3,835,742, Column 3, lines 23-68; Column 4, lines 1-2; and U.S. Pat. No. 4,015,494, Column 4, line 4—Column 5, line 20 set forth examples of representative circuitry and means to control slice thickness.

WEIGHING APPARATUS

During operation of the system the slices of the product 28 are stacked on the receiving veins of the stacker paddles until a preselect number of slices have been deposited therein at which time the paddles are accuated to transfer the stacked sliced product onto the weighing apparatus 10. The conveyor 16 of this assembly is constantly driven by a motor which, through the operation of circuitry as described for example in U.S. Pat. No. 3,200,864, is adapted to operate at low speed of travel of the conveyor during the depositing of the sliced stacks thereon by the stacker, and an increased speed in order to remove the weighed stacks therefrom in minimum time.

The conveyor 16 is conveniently mounted so as to accuate a scale 32 following reception of the stack of sliced products to be weighed. The weighed stack is then transferred onto the reject conveyor 22 at which point those stacks within the correct weight tolerance will pass to the transverse conveyor 20. Those stacks not of proper weight will be pushed or shifted aside by means of the reject conveyor in accordance with signals transmitted by the scale 32. The stacks of proper weight, are then taken to the packaging station 18, while stacks of improper weight are corrected and eventually similarly directed.

In usual operation, the scale 32 will generate a pulse when registering those stacks outside of the prescribed limit, which may be transferred to a servo mechanism utilized to adjust the slice thickness thereby correcting whatever error may be present in the stack weight. The mechanics of this, may be such as that set forth in the aforementioned patents.

Of course in the case of those systems wherein it is desired to have the stacker mounted on the weighing apparatus, the operation and the advantages of this type of an arrangement may be incorporated into the system as set forth in those patents previously mentioned which provide for such an arrangement.

In the illustrated weighing apparatus 10, the weight conveyor 16 is mounted on a scale 32 contained in a housing 34 having a hinged door 36 and legs 38. A tubular support 40 couples the weigh conveyor 16 to the scale 32. Under such circumstances, the stacked weight on the conveyor 16 will be transferred through the tubular support 40 to the scale 32 in a manner similar to that disclosed in U.S. Pat. Nos. 3,200,864 and 3,835,742. Again, it should however be realized, that the weighing apparatus does not per se constitute any part of the present invention; and one of the commercially available scales may serve the intended purpose.

However, it is desirous that the scale utilized in the present system be equipped with a tare correction system as disclosed in U.S. patent application Ser. No. 92,195 filed Nov. 6, 1979, commonly assigned to the present applicant. As disclosed by said application, as well as the references incorporated therein, the weighing apparatus would be equipped with a means of automatically correcting the control weight setting of the scale to compensate for any scraps or grease built-up on the scale during operation. This may be accomplished by periodically dropping a control weight on the scale each time the slicing machine is in an inoperative or return cycle, with control circuitry to reset the scale noll. The point to where it resets depends upon a comparison of the weight on the scale in a predetermined control weight setting. In this manner the build-up or grease on the weight conveyor does not affect the weight of the stack, this is taken into account periodically and the correction is made. In this regard, and as disclosed in said application, a solenoid means 42 is provided which is responsive to a signal eminating from the slicing machine, as later discussed, which will periodically lower and raise a predetermined weight 44 onto an extension 45 of the tubular member 40 so that the scale may be adjusted as aforementioned.

While the patent application Ser. No. 92,195 illustrates the tare correction system on a weighing apparatus with the stacker located on the scale, it should be understood that the tare correction is not limited to such an apparatus and can readily be incorporated into a system utilizing a weighing conveyor 16 as shown in the drawings.

SLICING MACHINE

The slicing machine 14 may be any one of the several different type of slicing machines presently being used in the cold cut slicing industry, with the modifications as herein after discussed. The basic slicer may be that of the type disclosed in the above referenced patents and one which is commercially available in a system manufactured under the name Anco, No. 1432 Cold Cut Slicing and Weighing System, manufactured by All Bright-Nell, a Division of Chemetron Corporation, 5323 South Western Blvd. Chicago, Ill. 60609. In a usual machine of this type, a conveyor or feeder 46 shifts forwardly thereby pushing the loaf 28 of the selected product towards the slicing blade 30. Usually, a slice thickness control mechanism is coupled with this feeder to increase or decrease the rate of travel of the feeder and consequently decrease and increase the slice thickness respectively. Also, the control mechanism and appropriate circuitry may be automatically adjusted in response to a signal from the scale 32 as aforementioned. Operation of the slicing machine 14 is similarly connected with the weighing apparatus to that discussed in the aforementioned patents, however, the drive for the drums is interconnected thereto rather than the conveyor or feeder 46 as later discussed. The modifications of the machine provide for an improved and somewhat continuous cold cut slicing operation.

As shown, the slicing machine includes a supporting table 48 having a channel or bed 50 running the length of the machine to receive the loaf 28 to be sliced. A feed conveyor 46 is provided in a mere portion of the channel rather than its full length. This conveyor initially receives the loaf 28 which is fed on the conveyor by way of a ramp feed 52, discussed more fully later.

The slicing machine, as aforementioned, includes a knife 30 contained in a knife housing 54 located at the discharge end of the slicing machine. Adjacent the knife housing is provided four drum drivers 56, 58, 60 and 62, with two located on each side of the channel in a parallel arrangement so as to engage the opposite sides of the loaf as it passes therethrough. These drums may be made of plastic and have a ribbed circumference to engage the loaf. Since the conveyor 46 does not run the entire length of the channel, a function of the drum drivers will be to feed the loaf into the knife after the loaf has left the conveyor. The channel bed 64 adjacent the drums may be relatively smooth as compared to that portion of the bed of the channel comprising the conveyor 46, since a frictional engagement of the loaf with the bed in this area is not necessary, due to the driving of the drums.

A channel wall 66 is provided throughout the length of the channel and may be integrally constructed with suitable openings 67 and 68 to allow a portion of drum 56 and 58 respectively to pass therethrough to engage the loaf in operation. This channel wall would be of a fixed nature and in addition, have an opening for a rear 70 limit switch whose operation will be later discussed. Adjacent the housing, is a second channel wall 72, which terminates short of the ramp feed 52 so as to allow the feeding of the loaves 28 onto the conveyor 46. The channel wall 72 similarly includes appropriate openings 73 and 74 for drums 60 and 62 respectively so as to allow them to engage the loaf during operation. In addition, the wall 72 has a flared portion 75 which facilitates the entry of the loaf into this section of the channel.

The drums 60 and 62 are for an adjustable nature so as to allow variation of the channel width to accommodate the varying width of the different types of loaf, and may be adapted to be automatically adjusted to allow the use of various types of grippers which may require more channel width when the gripper moves between its up and down position. This automatic adjustment may be made pneumatically or hydraulically and is later discussed. Thus, the slicing machine may readily utilize different shaped grippers and loaves.

The slicing machine is also provided with a housing 76 which would contain all of the control circuitry for operation of the machine. Circuitry contained therein would include that standard to the operation of the system as disclosed in the aforementioned patents, and in addition may include circuitry to provide the profile compensation control system as disclosed in Ser. No. 92,195, aforementioned, which may be advantageously included to accommodate the common tapers on the front and back end of the loaf. In this regard, as hereinafter discussed, many aspects of the present invention provide for an improvement of such a system due to its ability to keep a constant monitoring of a location of the tail end of the loaf being sliced and the front end of the next succeeding end of the loaf.

Figure 3:
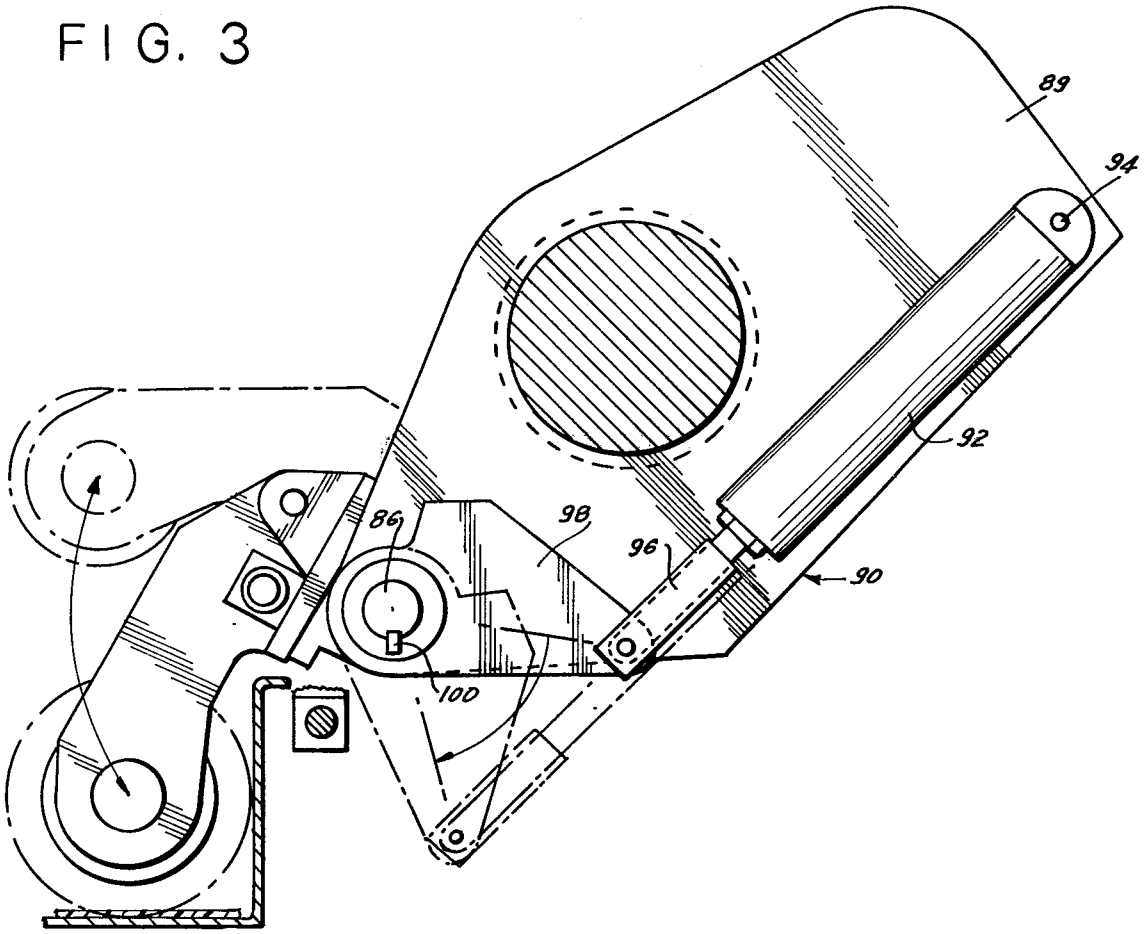
FIG. 3 is a sectional view along lines 3—3 of FIG. 2B showing the carriage tilt mechanism.

In this regard, in the drawings the slicing machine is provided with a loaf gripping assembly 78 and as illustrated having a suction cup 80 to grip the end of the loaf when it is in the channel. Of course, if so desired, a variety of other grippers, possibly of a mechanical i.e., claw gripper, type rather than vacuum type may readily be incorporated into the system. Connected to this suction cup 80 would be a source of vacuum (not shown) which may be that standardly used on presently commercial slicing machines. The suction cup 80 is supported by a gripper carriage 82 which includes a rectangular plate 84 which is supported by a guide or carriage shaft 86 which runs parallel to the channel and is supported at each end by way of braces 88 and 89 so as to allow the carriage to move parallel to the channel. Since the suction cup 80 is intended to grip the loaf in the channel and then withdraw when slicing is completed, as later discussed, it is necessary that the carriage be capable of moving from a raised or upward position so as to allow the loaf to pass through, and then into a lowered or down position, so that the suction cup may grip the trailing end of the loaf. In this regard, and as clearly shown in FIG. 3, a tilt mechanism 90 is provided to move the carriage between the two positions. This includes having a cylinder 92 mounted on the support 89 by way of a pivot pin 94, with a piston 96 pivotally connected to a plate 98 which engages the carriage shaft 86. A portion of said plate engages a carriage key 100 which causes a rotation of the shaft when the piston is activated resulting in the tilting of the gripper assembly from an up position to a down position. As later discussed, the cylinder to tilt the carriage may be activated by the limit switch 70 and the encoder arrangement via controlled circuitry. Also, the cylinder 92 may be of the pneumatic, hydraulic or solenoid type if so desired. As clearly shown in FIGS. 4–7, the gripper assembly includes a suction cup 80 as aforementioned, which is supported by an extending arm 104 attached to the rectangular plate 84 of the carriage so as to allow the suction cup to extend into the channel during operation. Located adjacent to the extending arm 104 is a pusher plate 106 whose position is varied during operation, with this being regulated by way of a cylinder 108 having its piston 110 connected to said plate with movement and support of said plate also provided by way of a rod 112 connected thereto; with said rod being mounted on the rectangular plate of the carriage by way of bearing mounts 114 and 116. The cylinder 108 is also mounted on the carriage by way of mounts 118 and 120 and, during operation, as later discussed, is adapted to be activated so as to vary the position of the pusher at appropriate times during the operation of the machine.

The carriage 82 is also fitted to a pair of rounded supports 122 and 124 which ride on the guide shaft 86 during operation. In addition, the carriage is provided with a pair of rollers 126 located on opposite sides of the guide shaft key 100 which runs the length of said shaft and assist in providing for relative ease of movement of the carriage on the guide shaft during operation. In addition, the carriage is fitted with a moving stop element 128 which is intended to engage a forward fixed stop 130 and rear fix stop 132 located on the shaft key 100 which prevent the carriage from going too far forward or rearward during operation.

Connected to the rear of the carriage is a linkage shaft 134. In this regard, mounted to the rear of the carriage is a semi-circular adapter 136 having a grooved portion thereon 138 which accepts a nipple portion 140 connected to the shaft 134. Through this arrangement the grooved portion 138 allows the carriage to be titled from its up to its down position with the nipple 140 slidably engaging said groove, so as to allow the linkage shaft 134 to remain rotationally fixed relative to the slicing machine. However, longitudinal movement of the carriage on the guide shaft 86 causes corresponding movement of the linkage shaft 134 by way of the engagement of the nipple 140 with the sidewalls of the grooved portion 138. This arrangement between the nipple 140 and the groove 138 can be clearly seen in FIG. 16, with the linkage shaft shown to be mounted in a rotationally fixed manner.

Figure 18:
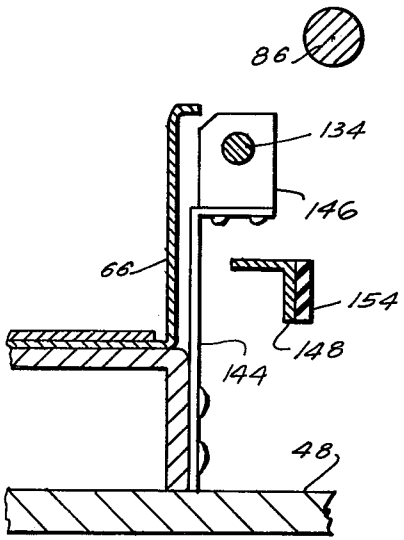
FIG. 18 depicts a sectional view of the linkage arrangement depicting a fixed support for the link carriage.
Figure 17:
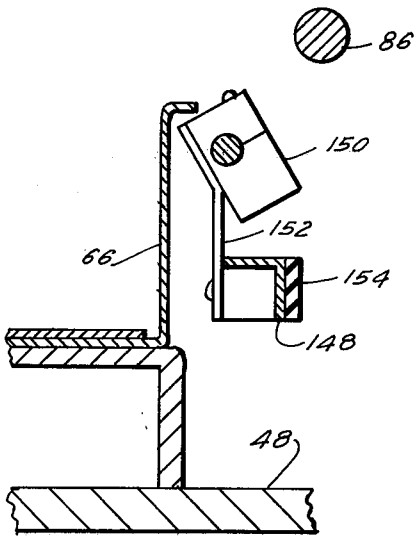
FIG. 17 depicts a sectional view of the linkage arrangement depicting a fixed support for the link rail located on the link carriage.
Figure 16:
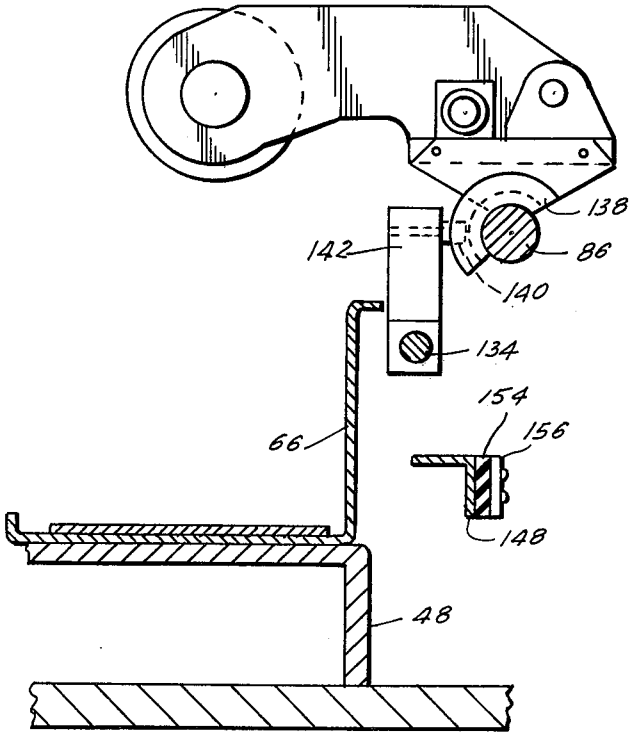
FIG. 16 depicts a sectional view of the linkage arrangement as it connects to the carriage.

In FIG. 16, the linkage shaft 134 is connected to the nipple 140 by way of a block portion 142. As shown in the FIGS. 17–18, the linkage shaft 134 is supported at its opposite end by way of a fixed support 144 mounted to the table 48 adjacent the channel wall 66. The shaft 134 has a sliding fit with a bearing 146 located on the mount 144 so as to support said shaft while allowing movement of the shaft therethrough during operation.

The linkage shaft 134 in turn provides support for a link carriage 148 which is mounted to said shaft by way of a mounting element 150 and extension element 152 to which said link carriage is fixedly mounted.

Figure 1B:
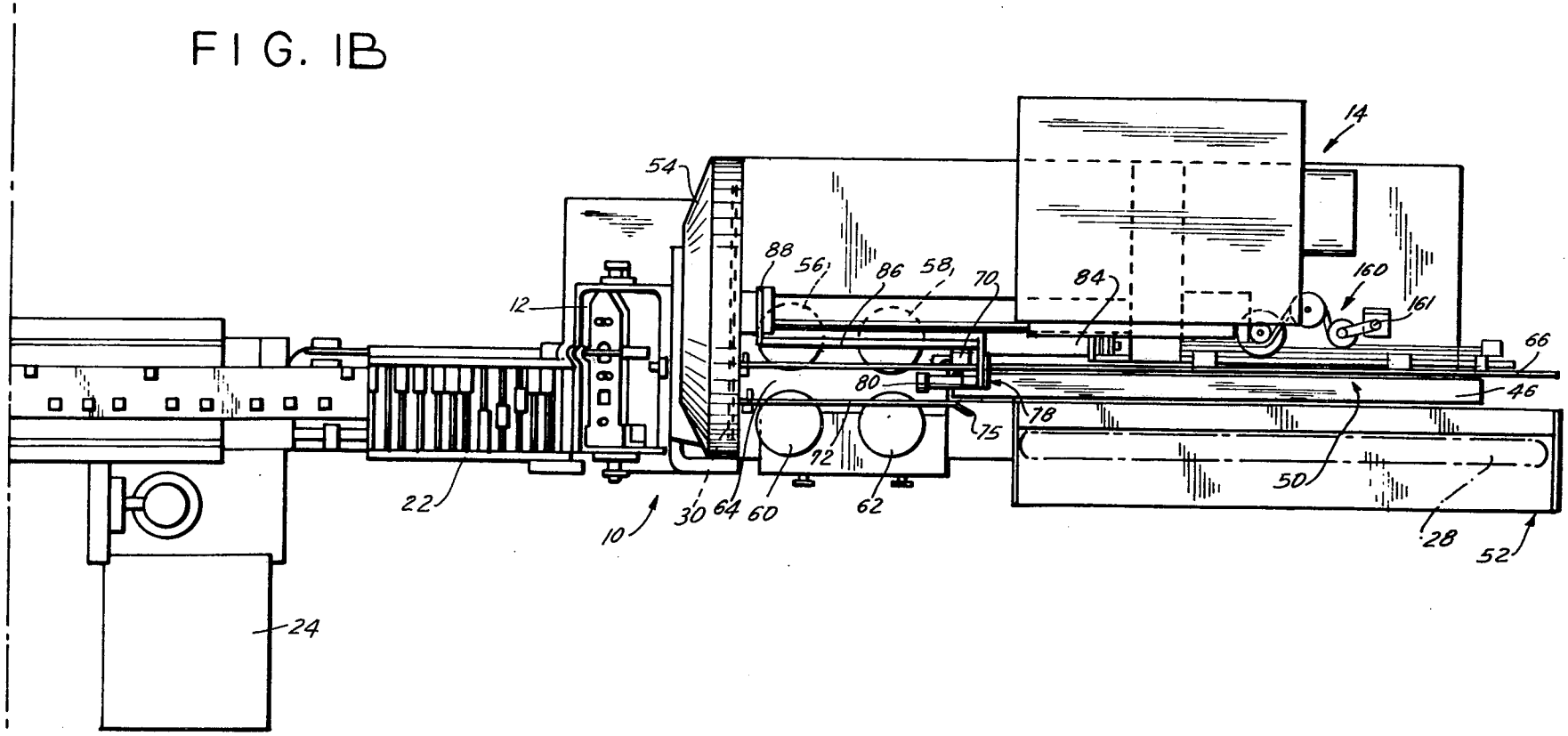
Figure 15A:
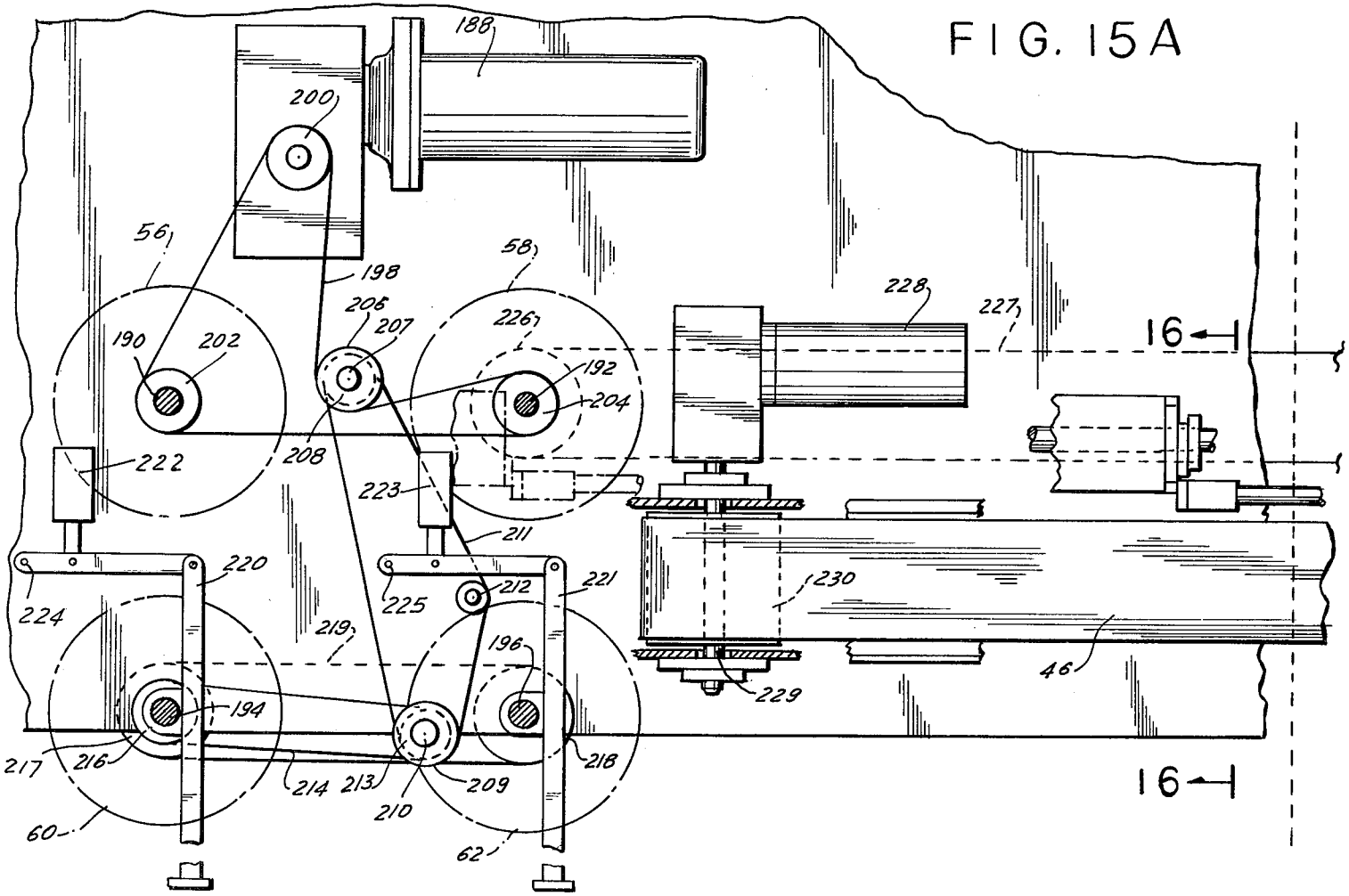
FIGS. 15A and 15B depict a plan view of the drive means for the slicing machine including the drive motors and the clutch, gear and linkage arrangement which indicates and somewhat regulates carriage movement.
Figure 15B:
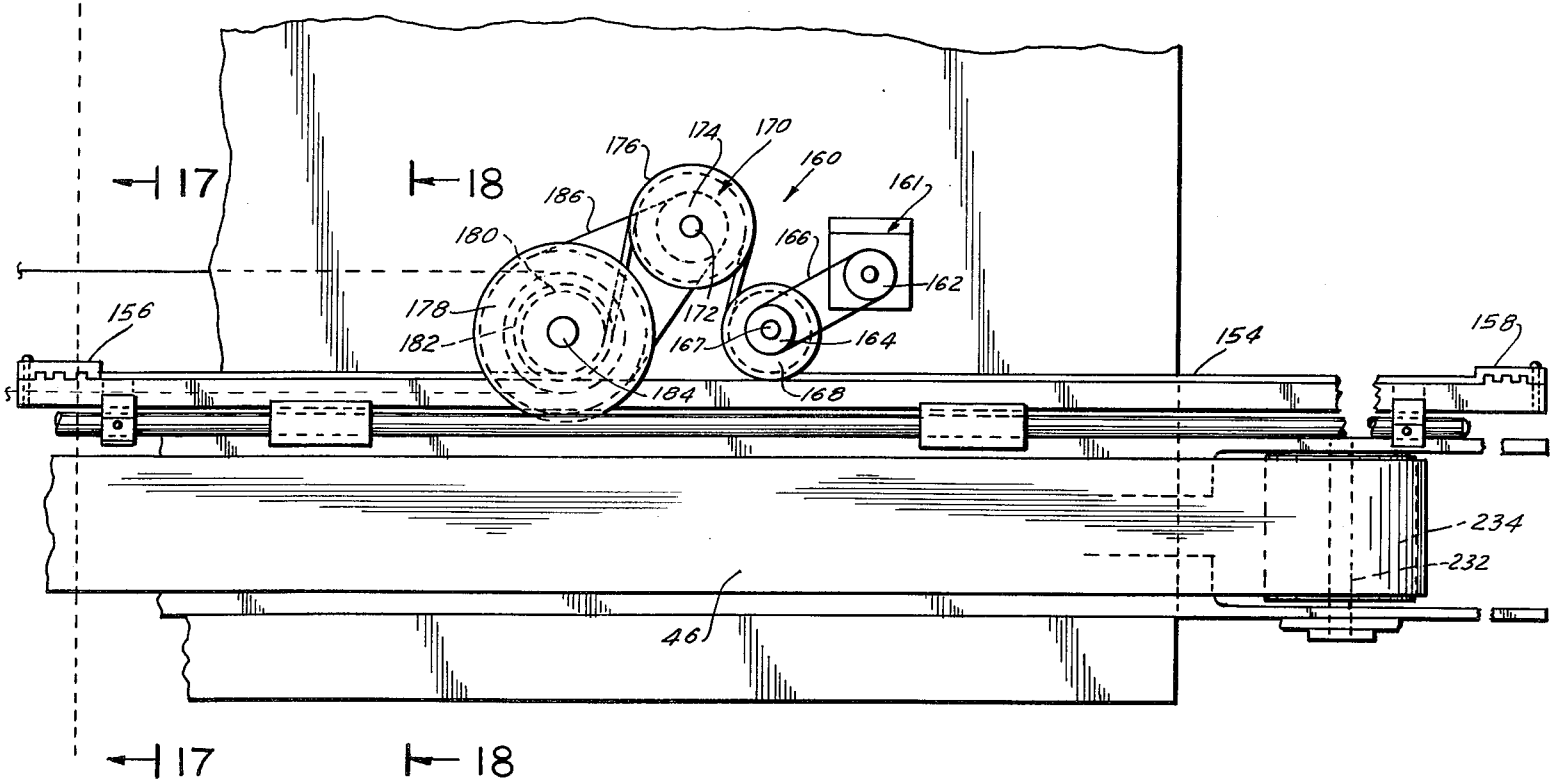

The link carriage 148 is intended to carry thereon a link belt 154 which is fixedly mounted on said carriage by way of clamps 156 and 158 shown in FIG. 15B. The belt should be of the notched type and of sufficient length to allow it to interact with the encoder and clutch arrangement 160 as shown in FIGS. 1B, 2B and 15B.

The encoder and clutch arrangement 160 serves to monitor the position of the gripper during operation of the machine by way of a potentiometer 161, having a gear 162 thereon, which is coupled to a gear 164 by way of belt 166. As seen in FIG. 2B and 15B, the gear 164 is located on a shaft 167, on which is also located a gear 168 which engages the link belt 154 during operation of the machine. In this manner, movement of the carriage causes a corresponding movement of a link belt across gear 168 which transmits this change in movement to the potentiometer 161 via gear 164, belt 166 and gear 162. The change in the potentiometer can then be used by way of conventional connections to signal to the control circuitry the position of the gripper and carriage during all phases of operation of the machine.

The encoder and clutch arrangement 160 also includes a clutch 170 positioned on a shaft 172 on which is also located gears 174 and 176. Adjacent this arrangement is gears 178, 180 and 182 all located on a shaft 184. Incidentally, the shafts 167, 172 and 184 may be mounted on the supporting table 48 in any conventional manner so as to allow free rotation of the shafts thereon. The link belt 154 takes somewhat of a torture path throughout the clutch and the encoder assembly, initially engaging gear 180, which is an idler gear; then turned about gear 176 and lastly engages gear 168. In this manner movement of the link belt 154 will cause an associate movement of each of the aforementioned gears 180, 176 and 168 during movement of the gripper and carriage. A belt 186 is provided between gears 178 and 174 so as to allow the clutch 170 to regulate the rotation of the shaft 184 which becomes of importance during the operation of the machine as hereinafter discussed.

Figure 2A:
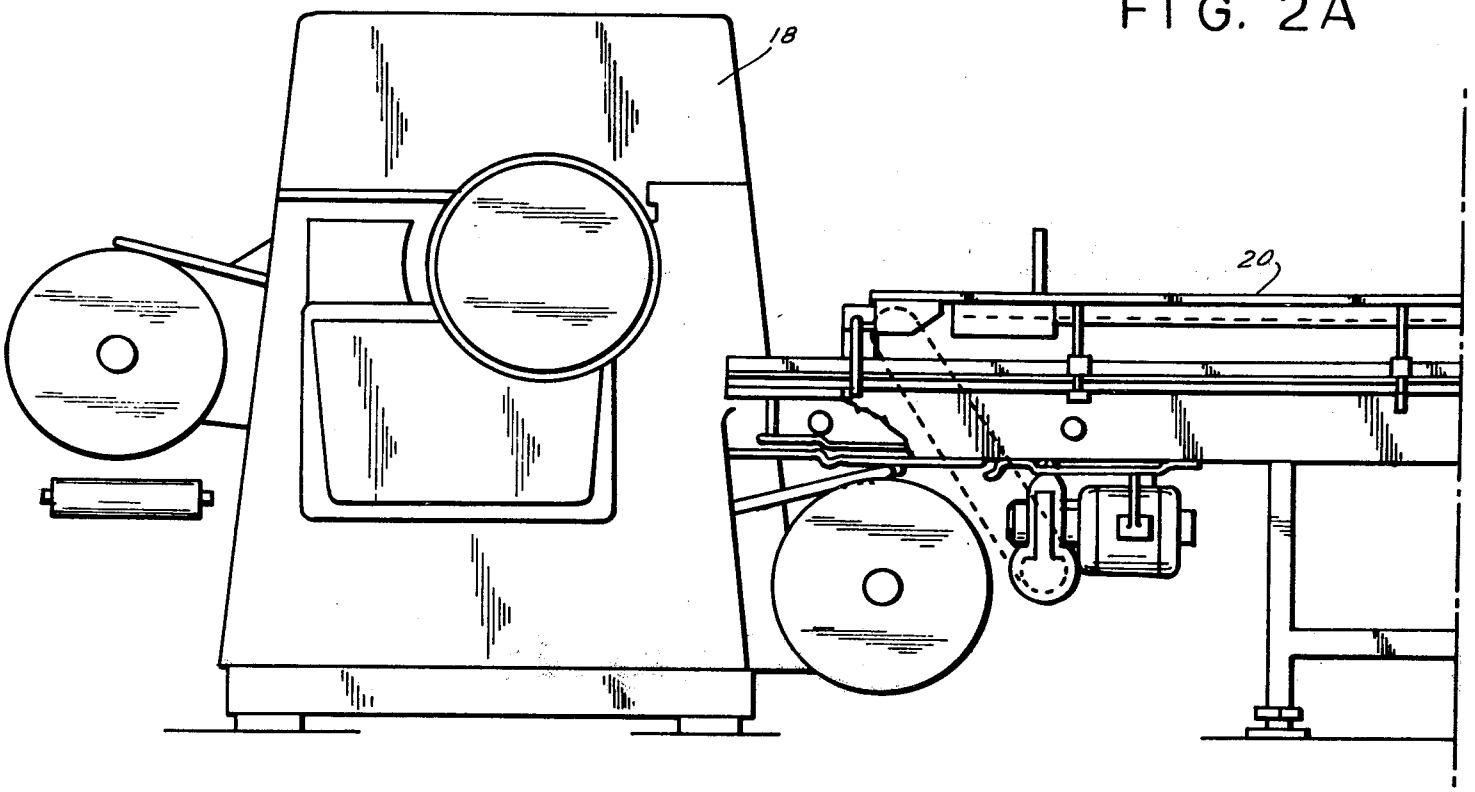
FIGS. 2A and 2B depict a side elevation view of the system incorporating the teachings of the invention.
Figure 2B:
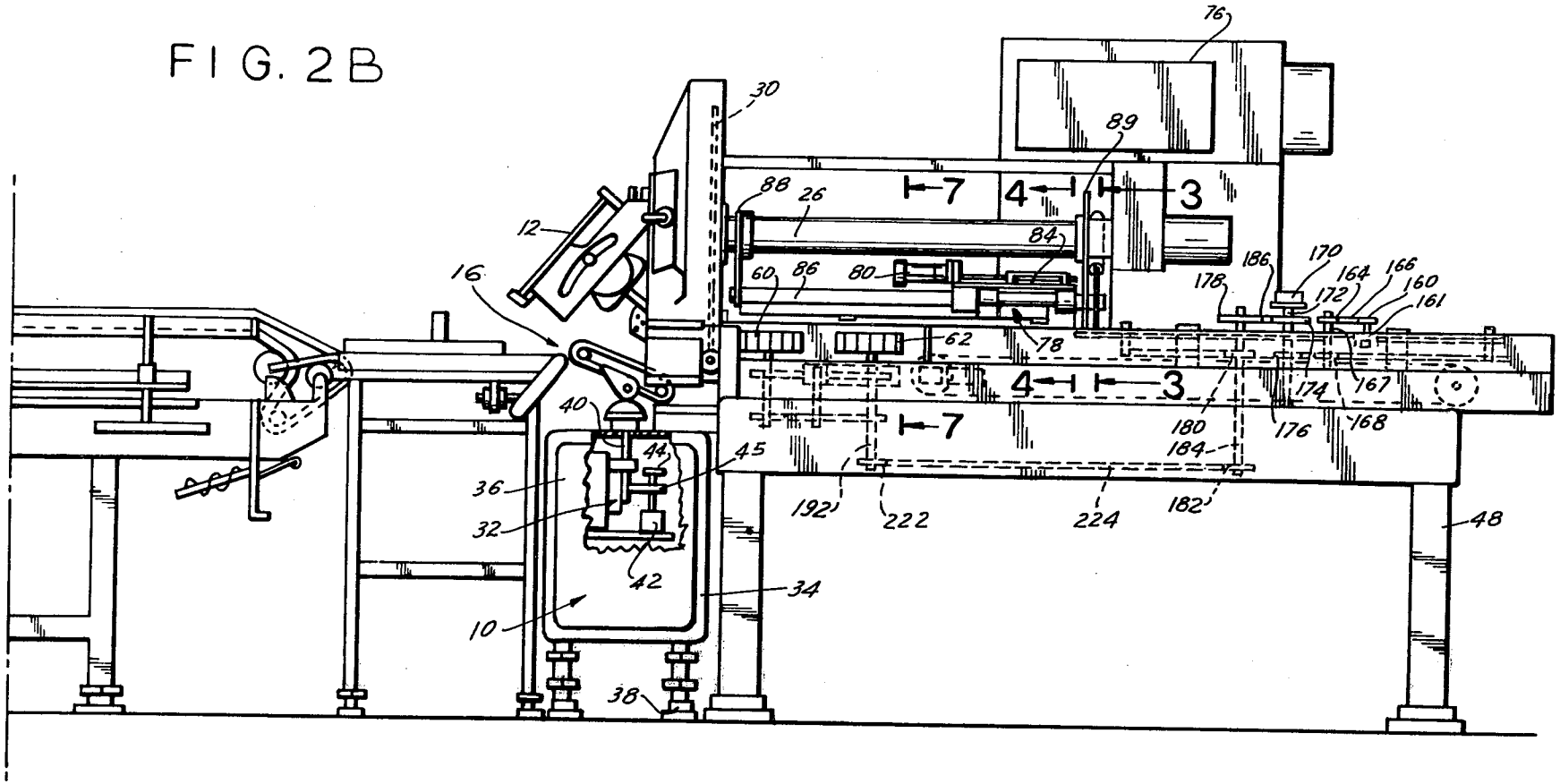

In this regard, referring now to FIGS. 15A and B in conjunction with FIG. 2B, the drive means for the various elements of the slicing machine are illustrated along with their interrelation with the clutch and encoder assembly 160. A motor 188 is provided to drive the drums 56, 58, 60 and 62 which are mounted on shafts 190, 192, 194 and 196 respectively. A belt 198 is provided to drive the drums which engages a gear 200 located on the motor 188 with said belt engaging gears 202 and 204 located on shafts 190 and 192 respectively, and gear 206. Gear 206 is located on shaft 207 on which is also located gear 208. To convey drive to the drums 60 and 62, a gear 209 is provided and positioned on shaft 210. A belt 211 is positioned to engage gear 208 and 209 while being biased by an idler gear 212. This effectively transfers drive to the side of the channel to which drums 60 and 62 are located. An additional gear 213 is provided on shaft 210 which transfer a driving force to shaft 194 by way of belt 214 and gear 216 positioned on said shaft. This driving force is then capable of being transferred to drum 62 via a gear 217 mounted on shaft 194, a gear 218 mounted on shaft 196 and a belt 219 between gears 217 and 218.

By such an arrangement, a driving force is transmitted equally to all of the drums and in addition drums 60 and 62 may be adjusted manually by adjustable linkages 220 and 221 as to allow for varying size of the gripper and loaves without an adjustment in the driving belts, with gears 206 and 212 being spring loaded to provide slack in said driving belts or take up slack in said driving belts 198 and 211. In this regard, the driving drums may be mechanically adjusted to vary the adjacent channel width, or may be automatically adjusted by pneumatic, hydraulic or electrical means, shown as cylinders 222 and 223.

In this regard, cylinders 222 and 223 are connected to linkages 220 and 221 respectively. The linkages pivot off pins 224 and 225 and are joined to shafts 194 and 196 respectively.

When the gripper is being tilted down into the channel, a signal may be sent by way of conventional circuitry to cylinder 223, which causes the linkage to pivot, moving shaft 196 and drum 62 away from the channel allowing for the tilting down of the gripper, especially when oversized grippers are used. Once down, the cylinder would return the linkage to its initial position possibly by a signal originating at the encoder via conventional circuitry. Similarly, cylinder 222 can be activated to move drum 60 when the gripper is being tilted from its down to its up position.

The shaft 192 has located thereon a gear 226 which engages a belt 227 provided so as to engage gear 182 and 226. In this manner, when the clutch 170 is signaled to retract the gripper, the drive for this may be by way of motor 188 by gears 174 and 178 via belt 186; from the drive transmitted to shaft 192 and gear 226 by belt 198.

Similarly, when the clutch 170 is signaled by way of control circuitry (not shown) to provide drag on the gripper and carriage when appropriate, as later discussed, this may be accomplished by way of a reduction in a rotation of the shaft 172 and corresponding gear 176 which in turn engages link belt 154 thereby reducing the speed of the carriage and gripper. In addition, when the slicing of a loaf is completed and the carriage is to be returned, the clutch 170 will be signaled to provide a reverse drive on the link belt 154 which in turn will return the carriage and gripper to a starting position, as shown in FIG. 2B.

All of the aforementioned gears may be mounted on their respective shafts in any conventional manner with the shafts conventionally mounted on the support table to allow free rotation therebetween.

The drive for the conveyor 46 is provided by a drive motor 228 which drives said conveyor by way of shaft 229 and bearing surface 230. The opposite end of said conveyor is supported by shaft 232 and bearing surface 234, which allows free rotation of said conveyor about these elements. In the case of motors 188 and 228, they may be mounted onto the supporting table 48 in any conventional manner, and may be electrical in nature with their operation signaled by way of conventional circuitry.

Figure 4:
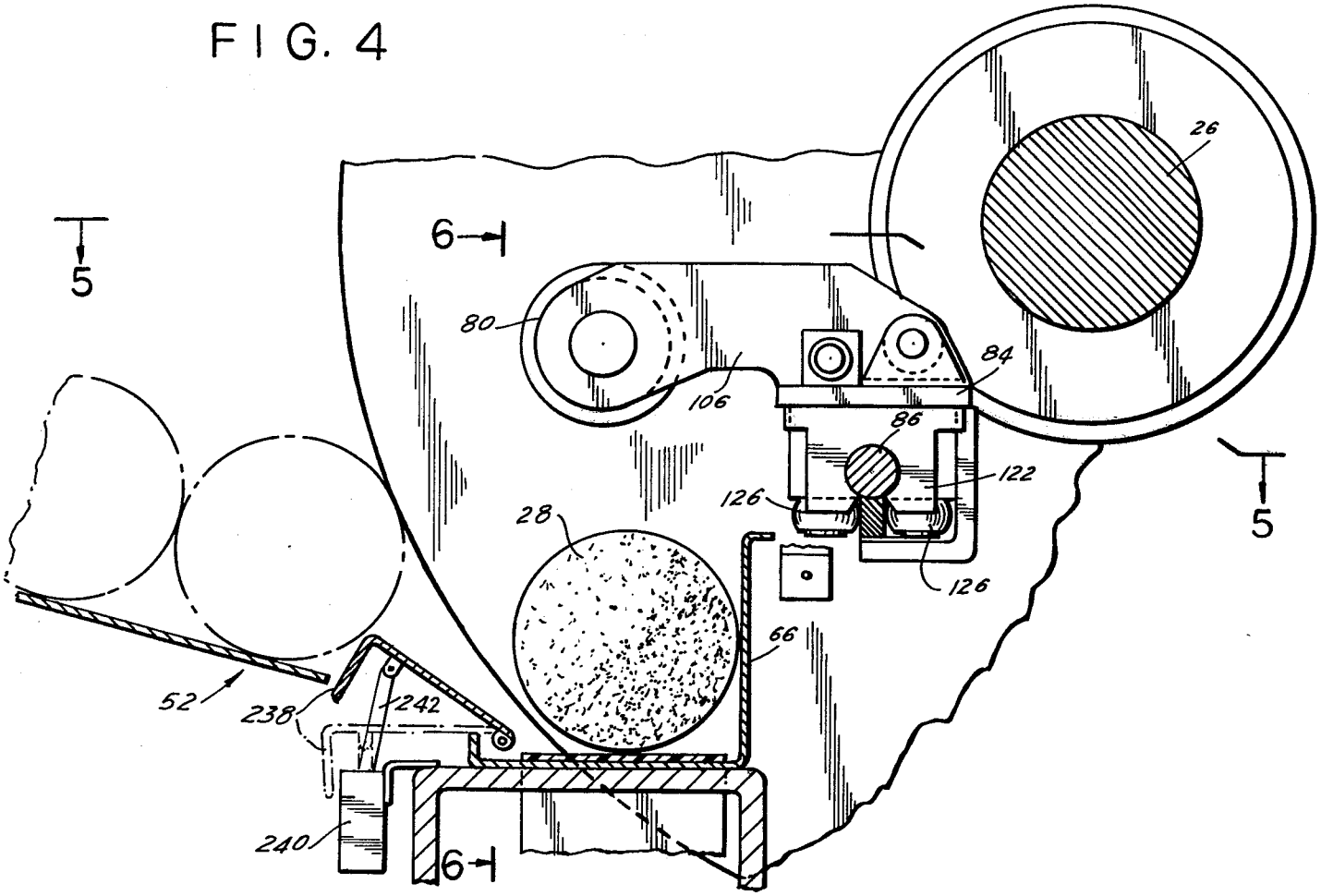
FIG. 4 is a sectional view along lines 4—4 of FIG. 2B depicting the carriage in its raised position.
Figure 5:
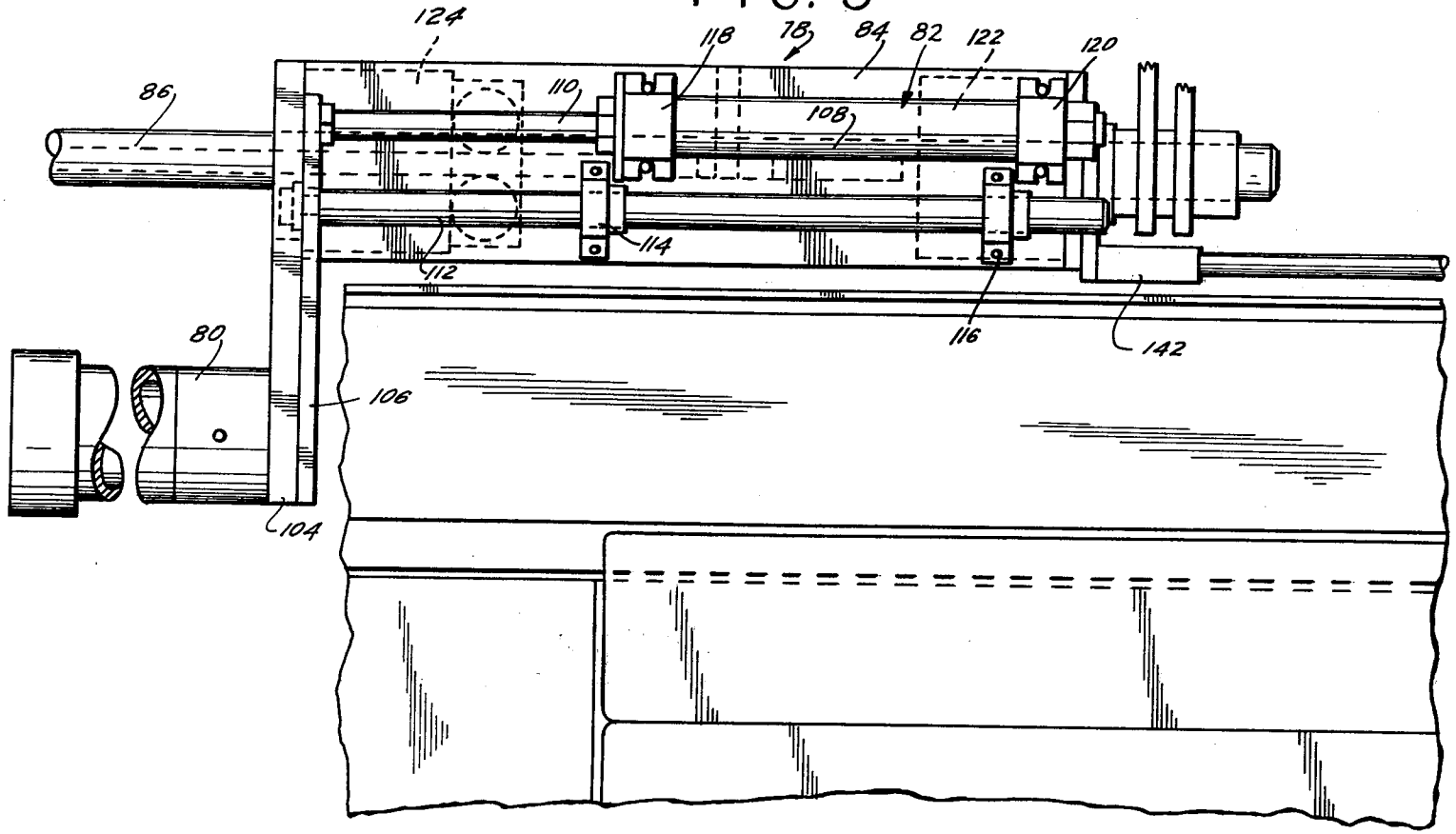
FIG. 5 is a horizontal sectional view along lines 5—5 of FIG. 4 with the carriage in its maximum rearward position.
Figure 6:
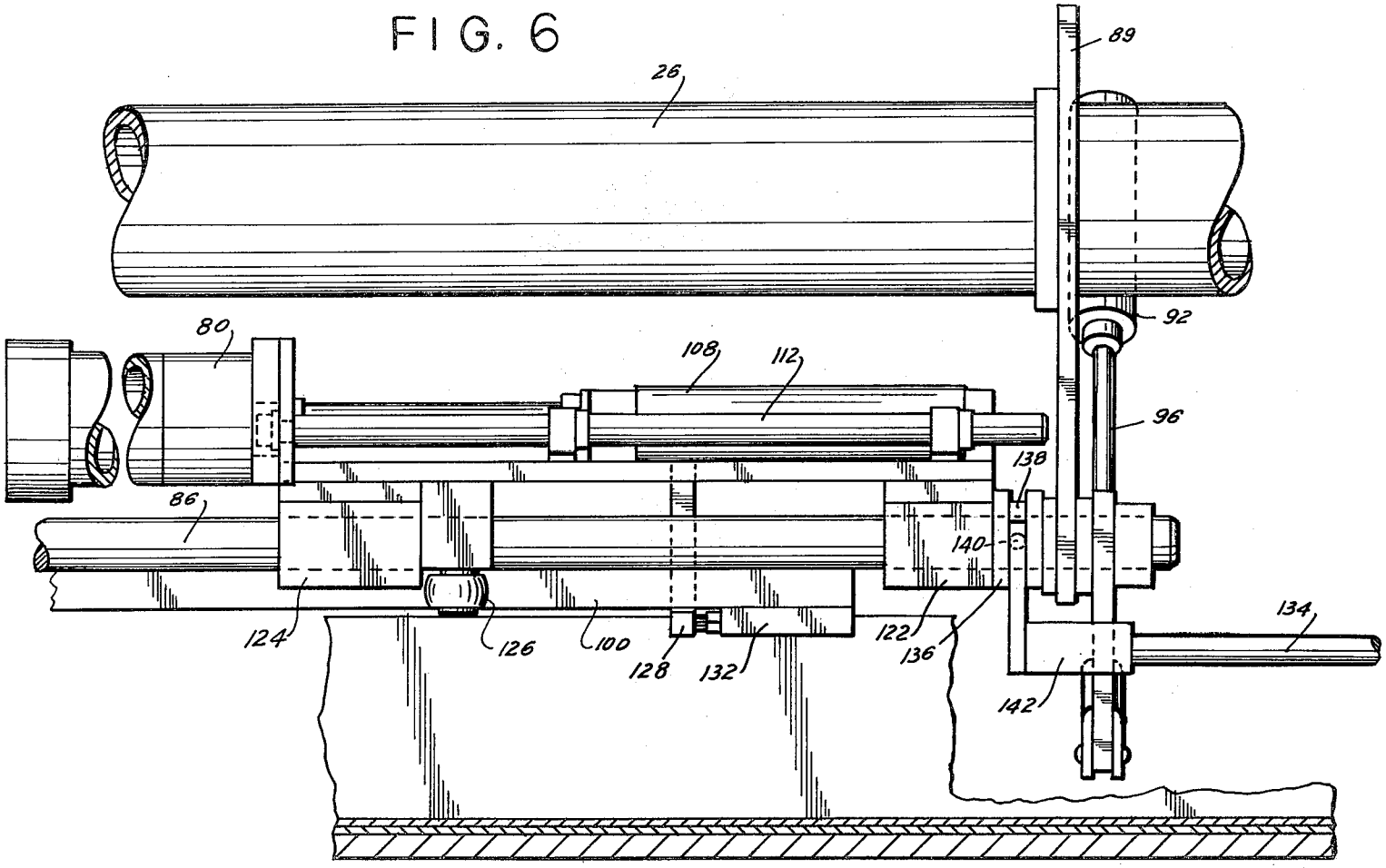
FIG. 6 is a vertical sectional view along lines 6—6 of FIG. 4 with the carriage in its maximum rearward position.
Figure 7:
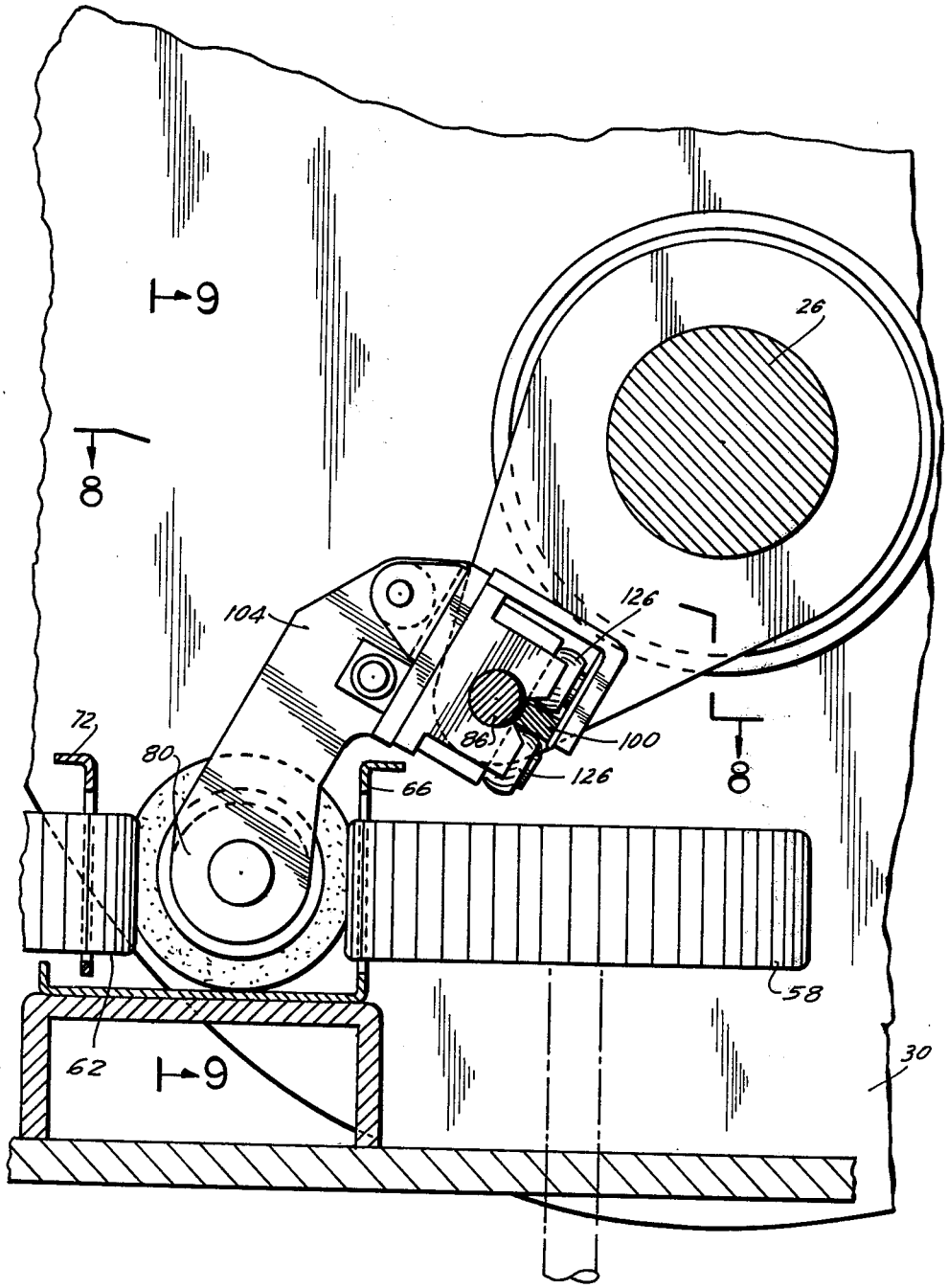
FIG. 7 is a sectional view along lines 7—7 of FIG. 2B with the carriage shown in its lowered and forward position.

As shown in FIG. 4, a ramp feed 52 is provided so as to allow a plurality of loaves 28 to be readied for feeding onto the conveyor 46. In this regard, a feed adjuster 238 is provided which is regulated by cylinder 240 and piston 242. This cylinder 240 is capable of receiving a signal so as to allow the feed adjuster 238 to move from its down position in phantom which inhibits the feed of the loaf onto the conveyor, to an up position, which allows the loaf to move onto the conveyor in an abutting relationship with the channel wall 66, allowing only one loaf to pass onto the conveyor with the feed means 238 returning to its down position by way of the cylinder 240 and piston 242.

OPERATION OF THE SLICING MACHINE

With regard to the operation of the slicing machine particular reference is now directed to FIGS. 8–14. With regard to FIG. 10, the initial starting position of the system is shown. In this regard, the cylinder 240 is signaled to allow a loaf of product to be sliced, designated by Roman Numeral I with subsequent loaves designated similarly in succeeding order, with loaf I shown to be on conveyor 46 which is now proceeding to drive loaf I towards the blade. This signal may originate with a start button, or any other type of conventional circuitry, turning the machine on, including the motor 188 and 228 for driving the drums and the conveyor respectively. The gripper and carriage is in its up position so as to allow loaf I to pass thereunder, tripping the rear limit switch 70. When the gripper and carriage is in the up position, the motor 188, which is variable speed, operates at an increased speed to drive loaf I quickly towards the blade. When the loaf is adjacent the blade, which is determined by the number of turns of the drums, and ready to be sliced, the motor 188 by way of conventional circuitry is signaled to decrease the drive speed to an initial prearranged speed for conventional slicing. At this juncture, the profile compensation control system as disclosed in the aforementioned application Ser. No. 92,195 may be engaged to compensate for tapers at the front end of the loaf. Thereafter, as discussed in said application and aforementioned patents, signals from the weighing apparatus 10 would be utilized to control slice thickness by regulating the speed of the motor 188 and corresponding feed of the loaf into the blade.

Figure 11:
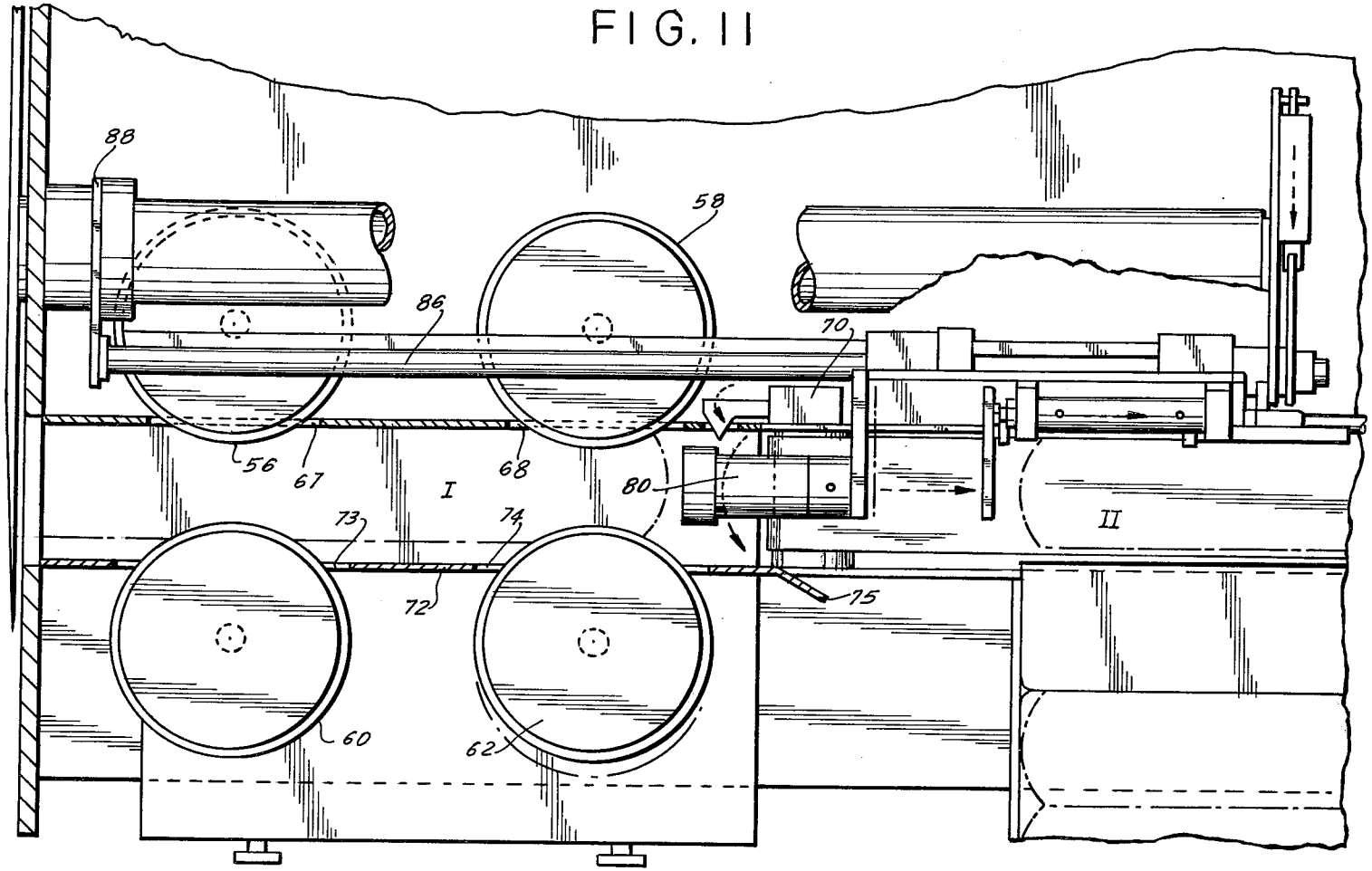

Heretofore, feed of the product into the blade had been by way of a conveyor running the length of the channel bed, with vertical hold down means to assist in controlling the feed of the product, compensating against any pull resulting from the turn of the knife. However, through the use of the drums, which may have ribs about their periphery as aforementioned, this horizontal driving force effectively controls the feed of the product to a point relatively close to the blade, with the gripper and carriage gripping the tail end of the loaf the remaining distance. In this regard, as shown in FIG. 11, the drums are effectively gripping loaf I with the tail end of the loaf is shown to have passed the rear limit switch 70. The cylinder 92 is now signaled by said switch or via control circuitry, to tilt the carriage into its downward position, with the suction cup 80 now located in the channel 50. Contemporaneously, cylinder 223 is signaled to temporarily retract drum 62 as aforementioned and as shown in FIG. 11. At this point, the cylinder 240 has been signaled to allow loaf 11 to enter the channel which is now resting on conveyor 46. In addition, the pusher 106 has been pulled back away from the suction cup by way of a signal transmitted to the cylinder 108, again, which may eminate from control circuitry which is signaled by the rear limit switch, with said circuitry also provided a signal to the cylinder 240. This may also signal the application of a vacuum to the suction cup with such vacuum arrangement well known in the art.

Figure 12:
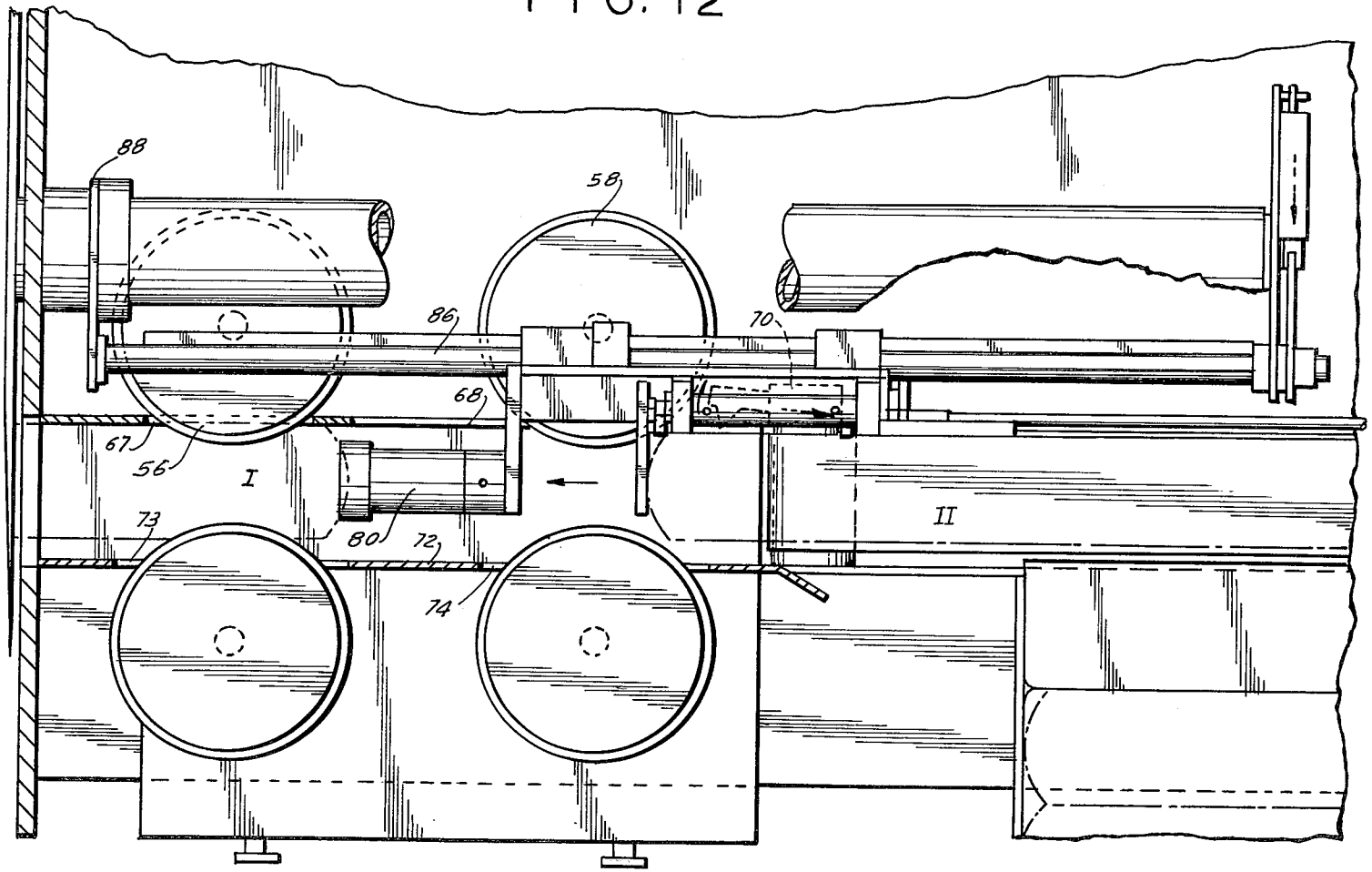

By pulling back the pusher plate 106, loaf II, now being driven by conveyor 46, will engage more quickly with said plate. This is important because the carriage movement at this point on shaft 86 is free wheeling and the drive to the carriage will be supplied by the abutment of loaf II with the pusher plate 106. The speed of the conveyor 46 is faster than the surface speed of the four drums so that loaf II pushes the rear plate of the carriage so that the suction cup will eventually catch up with the rear end of loaf I. This occurs essentially when the forward end of the suction cup is about equidistant between the forward pair and rear pair of drums 56 and 60, 58 and 62 respectively. At this point, as shown in FIG. 12, drive for loaf I is provided by the forward pair of drums 56 and 60 and loaf II being driven by conveyor 46.

Once the loaf I has passed beyond drums 56 and 60 the only drive to said loaf is by way of the force of loaf II on the pusher plate 106 thereby driving the carriage, suction cup and loaf I towards the blade. At this point, the potentiometer 161, which has been constantly monitoring the position of the carriage by way of linkage belt 154, now signals the control circuitry that the position of the suction cup is so that the loaf is no longer being regulated by way of the drums, and the clutch 170 is activated to provide a drag so that the throw of the knife does not disturb the loaf and consequently causes poor slices.

The rear drums, which are driven by motor 188 which is responsive to slice thickness control now drive the loaf II which in turn drives the gripper assembly so that the feed is responsive to slice thickness control signals eminating from the weighing apparatus along with the preset drag.

Further in this regard, as the suction cup and consequently the tail end of loaf I approaches the blade, at a predetermined position the profile compensation control system may be activated to compensate for taper on the rear end of the loaf to be sliced as disclosed in the aforementioned application Ser. No. 92,195; since its distance from the blade is determinable from the potentiometer 161.

Figure 8:
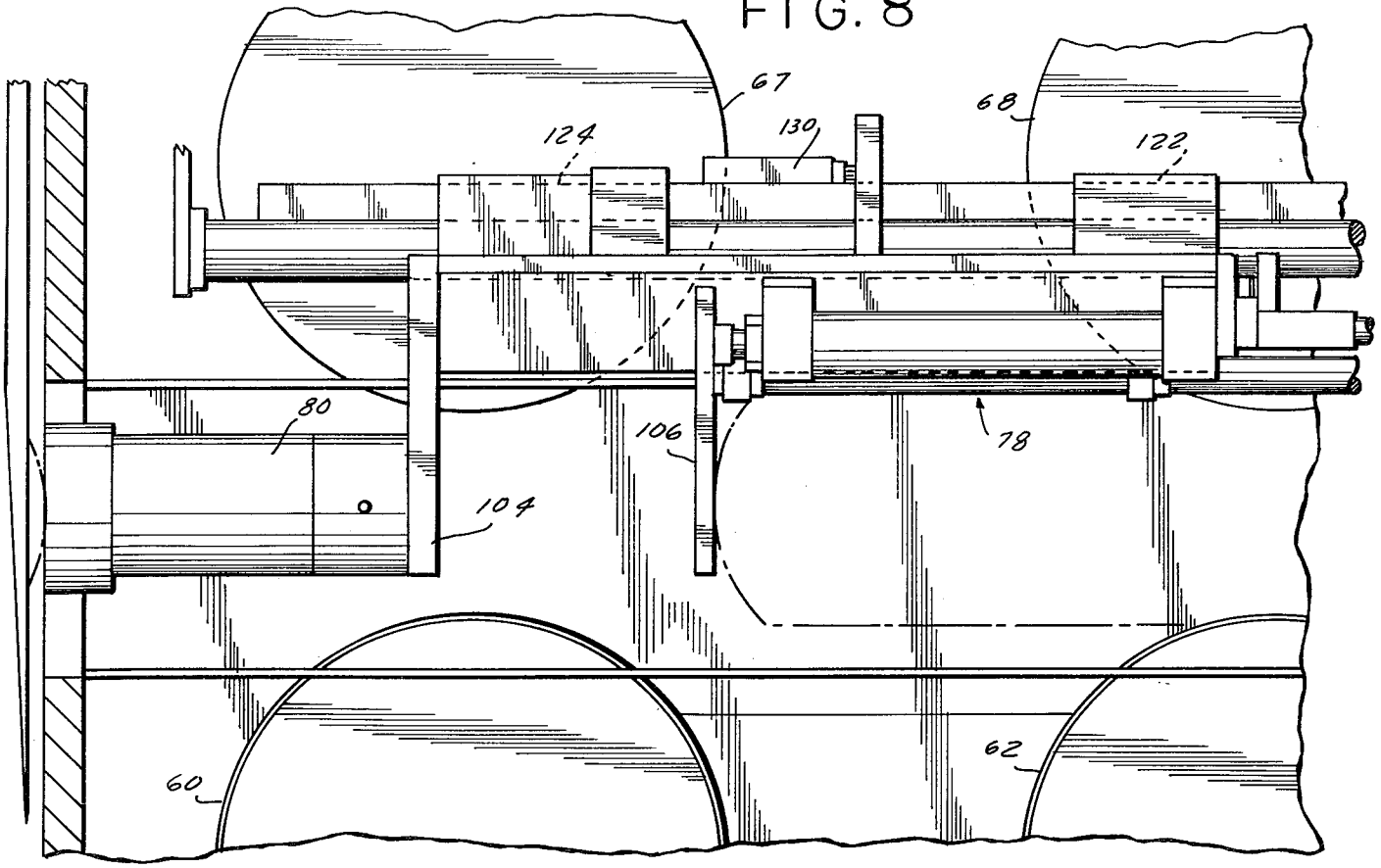
FIG. 8 is a horizontal sectional view along lines 8—8 of FIG. 7 with the carriage shown in its lowered and forward position.
Figure 9:
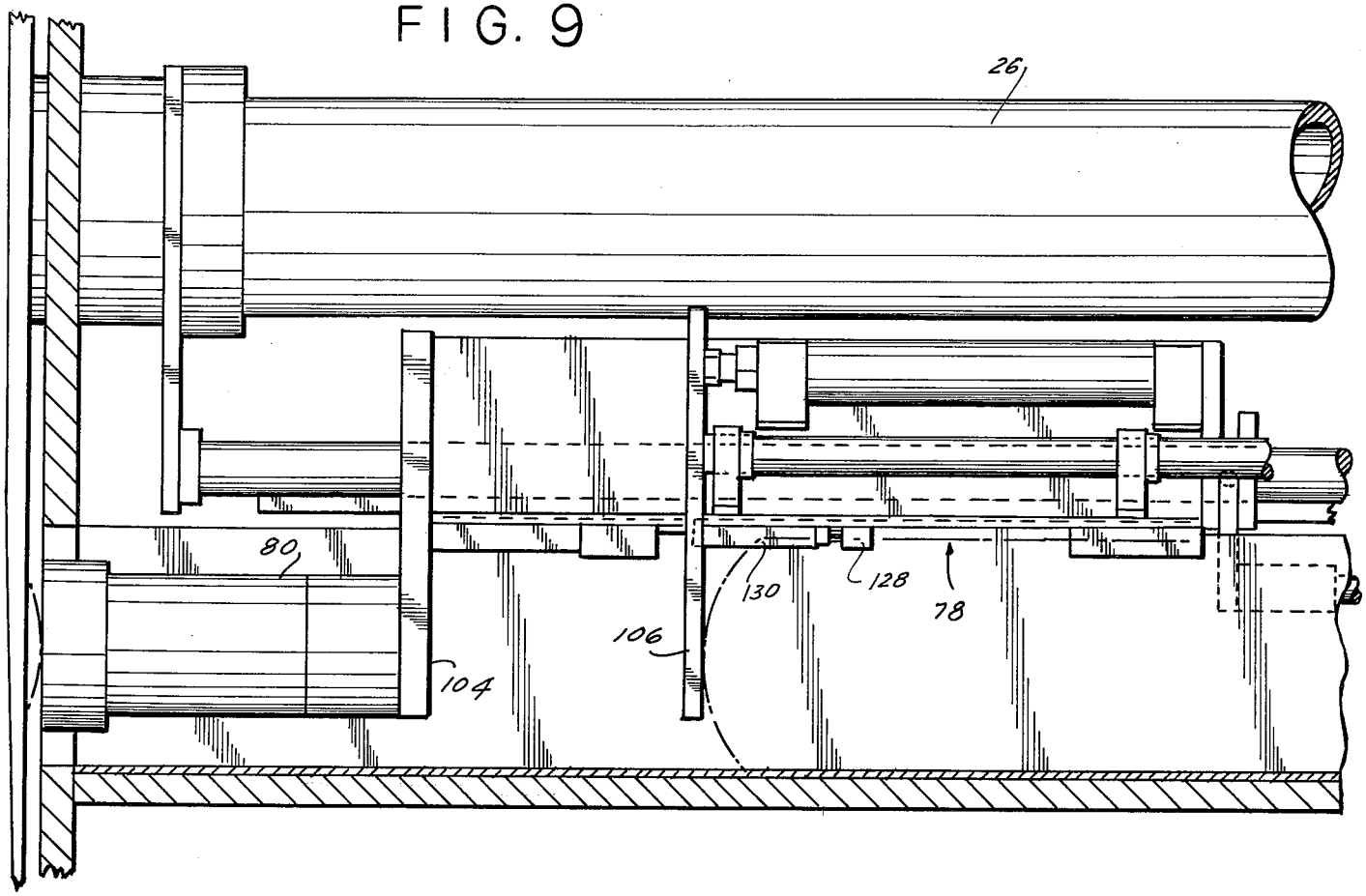
FIG. 9 is a vertical sectional view along lines 9—9 of FIG. 7 with the carriage shown in its lowered and forward position.
Figure 13:
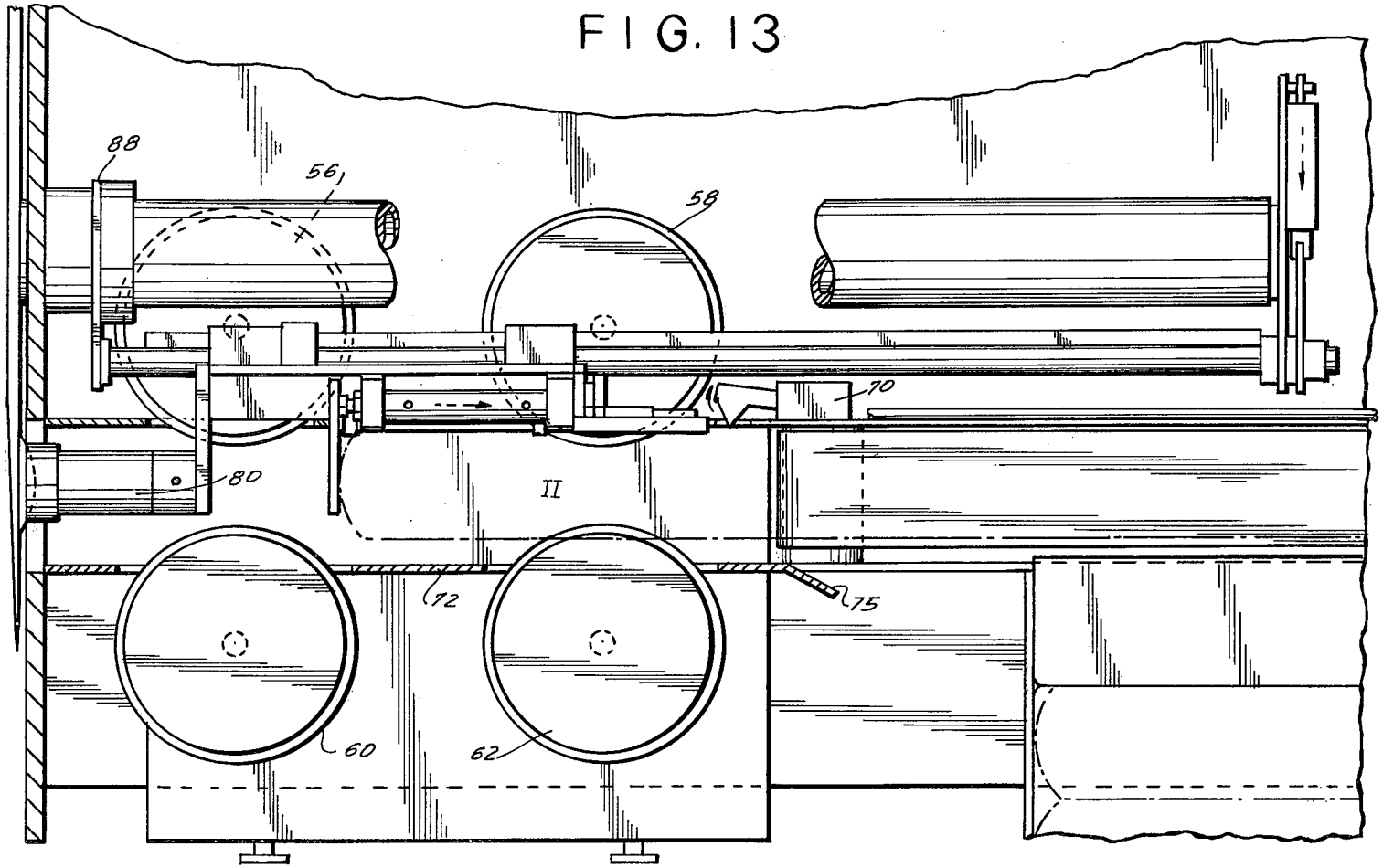

As shown in FIG. 13, when the suction cup is approximately ½ inch from the knife, the stop 128 engages the fix stop 130 on the key, (horizontal and vertical view of the carriage and suction cup in this position is shown most clearly in FIGS. 8 and 9). At this point, a signal may be sent from the potentiometer to the control circuitry indicating that the suction cup has reached this point. In the alternative, the forward fix stop may also be provided with a limit switch which would send a similar signal to the control circuitry. In either case, when the signal is received, a signal is sent from the control circuitry stopping the drive of motors 188 and 228.

Figure 14:
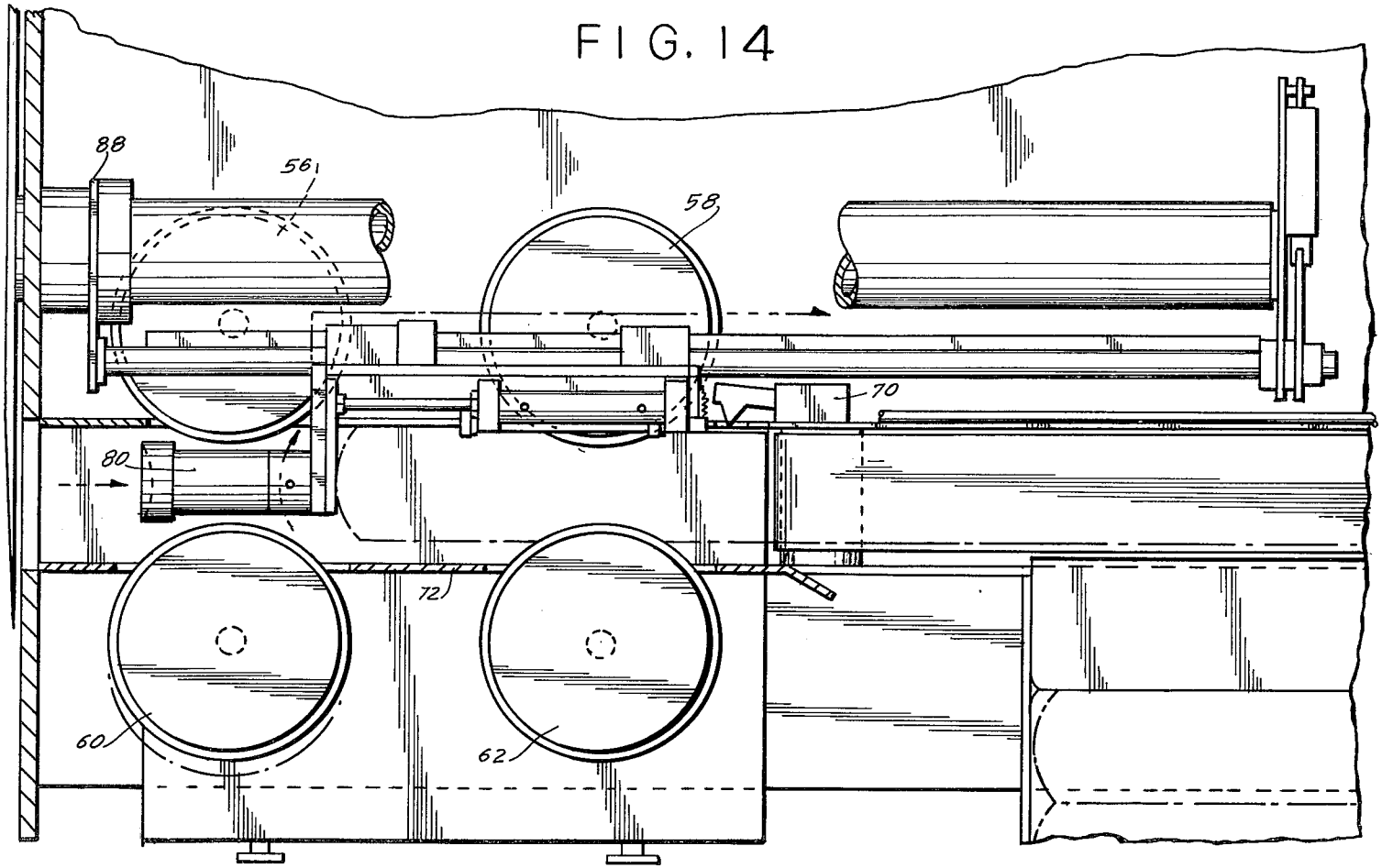

A signal is now sent from the control circuitry which results in cylinder 108 pushing the carriage back and suction cup approximately 4 inches back off the blade, with said movement being monitored by the potentiometer, which may then eminate a signal to the control circuitry which could then signal the cylinders 92 and 222 to tilt the carriage and suction cup from its down position to its up position and temporarily retract drums 60 as shown in FIG. 14. The retraction and tilting of the carriage and suction cup takes approximately 3 seconds and at the inception of the signal to stop the motors 188 and 228, a signal could also be sent to the weighing apparatus 10 allowing for the tare correction to take place, thereby utilizing all of the time the system operation.

Figure 10:
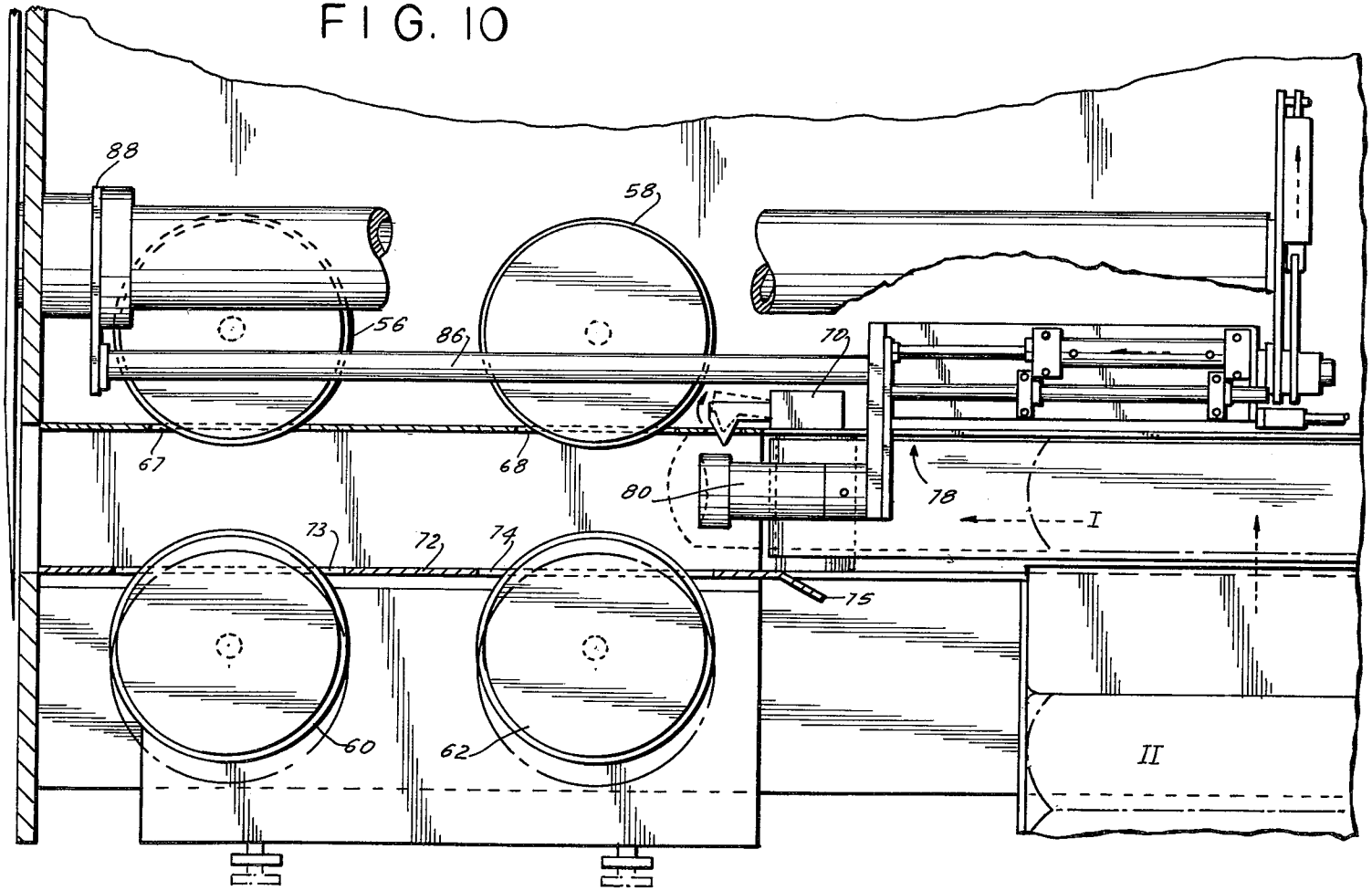
FIGS. 10-14 depicts plan sectional view of the sequence of operation of the elements of the system as the loaves are fed into the slicing blade.

Once the carriage and suction cup has been lifted out the channel 50 and the motors 188 and 228 are activated, with the motor 188 driving at a fast rate of speed so that the loaf II is placed into a slicing position as quickly as possible. At this point the carriage is now in its up position and the clutch may be signaled, by way of the control circuitry, to retract the carriage to its initial starting position as shown in FIG. 10 and as aforementioned. The foregoing sequence now repeats itself so that the system is in continuous operation, with somewhat continuous slicing of product taking place.

While it has been mentioned on numerous occasions that standard control circuitry may be utilized in regulating the operation of various elements of the system as signaled by the limit switch and the potentiometer arrangement, it should be understood that this could also include conventional pneumatic or hydraulic arrangements which may be activated and deactivated accordingly by way of such control circuitry. The potentiometer 161 utilized in the system may be of conventional design functioning by way of a change in voltage output related to displacement of the potentiometer, which in turn would indicate the position of the gripper and carriage during all phases of the operation of the machine, and which signals may then be utilized by the control circuitry.

In addition, it might be noted that since the gripper and carriage assembly does not return the full length of the channel but only a portion thereof, time previously lost is now saved. Also, during this time, as disclosed in the aforenoted patents, the vacuum to the suction cup when it is in its up position may be discontinued, allowing for the end piece of butt of the loaf contained thereon to be dropped off.

While a somewhat preferred embodiment of the present invention has been disclosed and discussed in detail herein; it should be understood that the scope of the invention should not be limited thereby, and said scope should be determined by that of the appended claims.

What is claimed is:

1. A combination of a slicing machine having a slicing blade for slicing a loaf of product having a front and rear end; a first feed means for feeding said loaf into said blade; a control means for determining the rate of feed of product by the first feed means towards said blade and consequently controlling slice thickness; a second feed means for feeding the loaf towards the blade when said loaf becomes disengaged from said first feed means during slicing operation which includes a gripper means for engaging the rear end of the loaf with said second feed means being driven towards the blade by the front end of the next succeeding loaf to be sliced; and a clutch means connected to said second feed means and capable of regulating the feed of the product.

2. The combination in accordance with claim 1 wherein said first feed means includes a plurality of rotating drums adjacent said blade, said drums engage the loaf with the rate of rotation of the drums and consequently the feed of the product towards the blade controlled by said control means.

3. The combination in accordance with claim 1 wherein said control means includes a variable speed motor adapted to receive signals which result in a change in the motor speed.

4. The combination in accordance with claim 1 wherein said gripper means is a vacuum type gripper.

5. The combination in accordance with claim 2 which includes a third feed means which feeds the loaf towards the blade, said third feed means comprising a belt conveyor which is located on said slicing machine, reaward of said drums, and operates to drive the loaf into engagement with said drums.

6. The combination in accordance with claim 5 which further includes a holding means for holding a plurality of loaves, with said holding means capable of being activated so as to periodically feed a single loaf onto said belt conveyor.

7. The combination in accordance with claim 6 including a rear indicating means rearward of said drums operatively connected to said control means, wherein in operation of the slicing machine, a loaf is fed onto the belt conveyor by the holding means, said conveyor drives said loaf into engagement with said rear indicating means and then to said drums, said rear indicating means signals and control means causing a feed of product towards the blade at a first rate of speed until adjacent the blade at which time the said control means feeds the loaf into the blade at a predetermined speed.

8. The combination in accordance with claim 7 which includes a tilt means capable of moving the second feed means between a first and a second position, said tilt means being operatively connected to the rear indicating means and responsive to a signal eminating therefrom; said holding means also being operatively connected to said rear indicating means and being responsive to a signal eminating therefrom; wherein at the beginning of operation of said slicing machine the second feed means is in its first position with the gripper means located somewhat adjacent said rear indicating means, and when the rear end of the loaf has passed said rear indicating means, said means signals said tilt mechanism and said holding means, with the tilt mechanism then moving the second feed means from its first to its second position; and the holding means allows a second loaf to pass onto the conveyor which then drives the second feed means into engagement with the rear end of the loaf being sliced.

9. The combination in accordance with claim 1 further including a monitoring means which is operatively connected to the second feed means and is capable of monitoring the position of said second feed means by providing an output which varies as a function of the change in distance between the second feed means and the slicing blade.

10. The combination in accordance with claim 9 wherein said monitoring means is a potentiometer having an output which is of an electrical nature which varies according to a rotational displacement of said potentiometer caused by a change in distance between said second feed means and the slicing blade.

11. The combination in accordance with claim 10 wherein the monitoring means is connected to said second feed means by way of a linkage belt.

12. The combination in accordance with claim 9 wherein said monitoring means is connected to said clutch means with the output of said monitoring means capable of activating said clutch means at a predetermined position of said second feed means.

13. The combination in accordance with claim 8 further including a monitoring means connected to the second feed means which monitors the position of said second feed means by providing an output which varies as a function of the change in distance between said second feed means and the slicing blade, said monitoring means being operatively connected to said tilt means and said second feed means so as to provide signals thereto, the second feed means being capable of retracting said gripper means away from the blade so as to allow the second feed means to move from the second position to the first position upon completion of slicing of the loaf; wherein, in operation, upon completion of the slicing of the loaf, the monitoring means signals the second feed means to retract the gripper means and signals the tilt means to move the second feed means from the second position to the first position.

14. The combination in accordance with claim 13 wherein said monitoring means is operatively connected to the clutch means so as to provide a signal thereto, said clutch means being capable of retracting said second feed means away from the blade to the position of the second feed means at the beginning of operation, wherein when said second feed means is moved from the second position to the first, the monitoring means signals the clutch means to retract the second feed means to its position at the beginning of operation.

15. The combination in accordance with claim 9 wherein said monitoring means is capable of signalling a weighing apparatus to compensate for tare.

16. The combination in accordance with claim 15 wherein said monitoring means is capable of signalling said weighing apparatus when the gripper means is being retracted away from the slicing blade.

17. The combination with claims 9, 15 or 16 wherein said monitoring means is capable of providing an output utilizable in engaging a profile compensation system.

18. A combination of a slicing machine having a slicing blade for slicing a loaf of product having a front and rear end; a first feed means for feeding said loaf into said blade; a control means for determining the rate of speed of product by the first feed means towards said blade and consequently controlling slice thickness; a second feed means for feeding the loaf towards the blade when said loaf becomes disengaged from said first feed means during slicing operation which includes a gripping means for engaging the rear end of the loaf with said second feed means being driven towards the blade by the front end of the next succeeding loaf to be sliced; and a monitoring means which is operatively connected to the second feed means and is capable of monitoring the position of said second feed means by providing an output which varies as a function of the change in distance between the second feed means and the slicing blade.

19. The combination in accordance with claim 18 wherein said first feed means includes a plurality of rotating drums adjacent said blade, said drums engage the loaf with the rate of rotation of the drums and consequently the feed of the product towards the blade controlled by said control means.

20. The combination in accordance with claim 18 wherein said control means includes a variable speed motor adapted to receive signals which result in a change in the motor speed.

21. The combination in accordance with claim 18 wherein said gripper means is a vacuum type gripper.

22. The combination in accordance with claim 19 which includes a third feed means which feeds the loaf towards the blade, said third feed means comprising a belt conveyor which is located on said slicing machine, rearward of said drums, and operates to drive the loaf into engagement with said drums.

23. The combination in accordance with claim 22 which further includes a holding means for holding a plurality of loaves, with said holding means capable of being activated so as to periodically feed a single loaf onto said belt conveyor.

24. The combination in accordance with claim 23 including a rear indicating means rearward of said drums operatively connected to said control means, wherein in operation of the slicing machine, a loaf is fed onto the belt conveyor by the holding means, said conveyor drives said loaf into engagement with said rear indicating means and then to said drums, said rear indicating means signals said control means causing a feed of product towards the blade at a first rate of speed until adjacent the blade at which time the control means feeds the loaf into the blade at a predetermined speed.

25. The combination in accordance with claim 24 which includes a tilt means capable of moving the second feed means between a first and a second position, said tilt means being operatively connected to the rear indicating means and responsive to a signal eminating therefrom; said holding means also being operatively to said rear indicating means and being responsive to a signal eminating therefrom; wherein at the beginning of operation of said slicing machine the second feed means is in its first position, and when the rear end of the loaf has passed said rear indicating means, said means signals said tilt mechanism and said holding means, with the tilt mechanism then moving the second feed means from its first to its second position; and the holding means allowing a second loaf to pass onto the conveyor which then drives the second feed means into engagement with the rear end of the loaf being sliced.

26. The combination in accordance with claim 18 wherein said monitoring means is a potentiometer having an output which is of an electrical nature which varies according to a rotational displacement of said potentiometer caused by a change in distance between said second feed means and the slicing blade.

27. The combination in accordance with claim 26 wherein the monitoring means is connected to said second feed means by way of a linkage belt.

28. The combination in accordance with claim 25 wherein said monitoring means is operatively connected to said tilt means and said second feed means so as to provide signals thereto, the second feed means being capable of retracting said gripper means away from the blade so as to allow the second feed means to move from the second position to the first position upon completion of slicing of the first loaf; wherein, in operation, upon completion of the slicing of the first loaf, the monitoring means signals the second feed means to retract the gripper means and signals the tilt means to move the second feed means from the second position to the first position.

29. The combination in accordance with claim 18 wherein said monitoring means is capable of signalling a weighing apparatus to compensate for tare.

30. The combination in accordance with claim 29 wherein said monitoring means is capable of signalling said weighing apparatus when the gripper means is being retracted away from the slicing blade.

31. The combination with claims 18, 29 or 30 wherein said monitoring means is capable of providing an output utilizable in engaging a profile compensation system.

32. The combination in accordance with claims 13 or 28 which includes a means of moving at least one drum in a direction perpendicular to and away from the gripper means when it moves from its first position to its second position and when it moves from its second position to its first position.

* * * * *

UNITED STATES PATENT AND TRADEMARK OFFICE

CERTIFICATE OF CORRECTION

PATENT NO. : 4,321,847

DATED : March 30, 1982

INVENTOR(S) : Oscar W. Dillon

It is certified that error appears in the above—identified patent and that said Letters Patent is hereby corrected as shown below:

Column 8, line 31, change "titled" to --tilted--;

Signed and Sealed this

*Seventeenth* Day of *August 1982*

[SEAL]

*Attest:*

GERALD J. MOSSINGHOFF

*Attesting Officer*

*Commissioner of Patents and Trademarks*